US005803369A

United States Patent [19]

Toyao et al.

[11] Patent Number: 5,803,369

[45] Date of Patent: Sep. 8, 1998

[54] ACCUMULATOR FUEL INJECTION DEVICE

[75] Inventors: Tatsuya Toyao, Kariya; Shuichi Matsumoto, Oobu; Masashi Murakami, Toyokawa; Yukihisa Arakoma; Masatoshi Kuroyanagi, both of Kariya, all of Japan

[73] Assignee: Nippondenso Co., Ltd., Kariya, Japan

[21] Appl. No.: 686,774

[22] Filed: Jul. 26, 1996

[30] Foreign Application Priority Data

Jul. 26, 1995 [JP] Japan ..... 7-190464

[51] Int. Cl.[6] ..... F02M 51/02

[52] U.S. Cl. ..... 239/533.8; 239/585.1

[58] Field of Search ..... 239/533.8, 96, 239/585.1–585.5, 124

[56] References Cited

U.S. PATENT DOCUMENTS

| | | | |
|---|---|---|---|
| 4,516,730 | 5/1985 | Fussner | 239/533.8 |
| 5,169,066 | 12/1992 | Ricco et al. . | |
| 5,183,209 | 2/1993 | Ricco et al. . | |
| 5,244,150 | 9/1993 | Ricco et al. . | |
| 5,246,165 | 9/1993 | De Matthaeis et al. . | |
| 5,464,156 | 11/1995 | Ricco et al. | 239/124 |
| 5,542,616 | 8/1996 | Auguston | 239/533.8 |

FOREIGN PATENT DOCUMENTS

| | | | |
|---|---|---|---|
| 304747 | 3/1989 | European Pat. Off. | 239/533.8 |
| 1-232161 | 9/1989 | Japan . | |
| 5-133296 | 5/1993 | Japan . | |

*Primary Examiner*—Kevin Weldon
*Attorney, Agent, or Firm*—Cushman Darby & Cushman IP Group of Pillsbury Madison & Sutro LLP

[57] ABSTRACT

In an accumulator fuel injection device, a valve member of a solenoid valve includes a shaft and a spherical member. The spherical member is slidably supported at the tip portion of the shaft. The spherical member is prevented from falling off by caulking the tip of the shaft. A flat plate working as a valve seat for the spherical member is provided so that the spherical member allows communication between a pressure control chamber and a low-pressure side when separated from the flat plate, while prohibiting the communication therebetween when seated on the flat plate. On the other hand, the flat plate is formed with fuel relief passages in a tight contact region between the flat plate and the spherical member. The fuel relief passages communicate with the low-pressure side even when the spherical member is seated on the flat plate. Thus, a hydraulic force applied to the spherical member in a solenoid valve opening direction when the spherical member is seated on the flat plate, is rendered smaller. Accordingly, a biasing force of a spring urging the valve member in a solenoid valve closing direction can be set smaller, and thus, a magnetic force of the solenoid valve for lifting the valve member against the biasing force of the spring can also be set smaller. The fuel relief passages may be provided on the spherical member.

34 Claims, 17 Drawing Sheets

ACCUMULATOR FUEL INJECTION DEVICE

BACKGROUND OF THE INVENTION

1. Field of the Invention

The present invention relates to a fuel injection device for a diesel internal combustion engine and, in particular, to an accumulator fuel injection system in which the high-pressure fuel is accumulated in a common rail, acting as a surge tank, and the accumulated high-pressure fuel is injected through a solenoid valve controlled injector.

2. Description of the Prior Art

A fuel injection system is known, wherein high-pressure fuel fed from a high-pressure pump is supplied to an injector directly or after being accumulated in a common rail so as to be at a constant pressure. A valve member opens and closes an injection hole of the injector. The fuel pressure in a pressure control chamber provided at a side of the valve member remote from the injection hole is controlled by two way solenoid valve so as to adjust the fuel injection timing and the fuel injection amount. Japanese First (unexamined) Patent Publications Nos. 5-133296 and 1-232161 disclose such a system.

In Japanese First (unexamined) Patent Publication No. 5-133296, the discharge of the high-pressure fuel from a pressure control chamber is prohibited by means of a tight contact between a planar surface of a valve member and a planar valve seat. Since the planar surfaces abut with each other, the manufacturing of the abutting portions is facilitated as compared with the conical abutting portions. Further, since the abutting area can be increased, abrasion at the abutting portions is reduced to ensure excellent sealing.

However, in the system disclosed in Japanese First Patent Publication No. 5-133296, since the fuel pressure in the pressure control chamber is exerted on the planar surface of the valve member in a valve opening direction, the set load of a spring for urging the valve member toward the valve seat should be increased. Thus, an attraction force of the solenoid valve for separating the valve member from the valve seat against the biasing force of the spring is required to be increased so that the solenoid valve is increased in size.

The foregoing Japanese First Patent Publication No. 1-232161 aims to reduce the bounce generated upon closing the valve without deteriorating the valve opening performance. Specifically, it describes increasing an abutting area in the tight contact region to enhance the damping coefficient and to decrease the bounce. Also, the hydraulic pressure is, introduced into the tight contact region upon opening the valve so as to facilitate the opening of the valve.

This employs the phenomenon that mirror-finished two metal planar surfaces under a certain pressure (atmospheric pressure in this publication) can not be separated from each other without introducing environmental pressure into the tight contact region between the two surfaces.

In Japanese First Patent Publication No. 1-232161, the abutting area is large relative to the opening area of the valve element. With this arrangement, the repulsion of the valve element, generated immediately after the valve closing, is reduced so as to suppress bounce. Naturally, for opening the valve at a given valve opening timing in this state, the opening force (attraction force of the two way solenoid valve) is required to be greater than where the abutting area is smaller. In view of this, a fuel groove extending from the vicinity of a fuel passage hole toward the outside of the tight contact region is provided on the valve element or the valve seat. By introducing the low-pressure fuel into this fuel groove, opening the valve opening is facilitated.

However, in the two way solenoid valve described above, since it is necessary to largely increase the abutting area at the seat portion (valve element and valve seat), the hydraulic load to be exerted in the solenoid valve opening direction is increased, or the sealing property of the valve becomes sensitive to the inclination of the valve element or the surface roughness of the abutting surfaces. Thus, this structure can not be employed in the two way solenoid valve which is used for switching the fuel having a pressure exceeding 100 MPa because the leakage can not be suppressed to a small value. Further, when the set stroke amount of the valve element is small, or in the state of the low stroke immediately after the valve opening, because the opening area is small and the passage length is lengthened corresponding to the increased abutting area, the flow coefficient is extremely decreased. Additionally pressure loss is unnecessarily increased. Thus, the pressure to be released cannot be sufficiently lowered near the seat portion even if the valve is opened, and it takes an extremely long time (dead time) for the pressure to be lowered after the a valve opening command signal is sent to the solenoid. Further, since the rebound coefficient is increased by facilitating the valve opening using the groove, the bounce reducing effect cannot be expected even if the abutting area is increased. Thus, the sealing property is deteriorated. This problem is more significant when applied to a small-sized diesel engine fuel injection device or injector. If the foregoing conventional technique is applied to the small-sized two way solenoid valve which is used for switching high-pressure fuel of no less than 100 MPa with a small force, nothing will be produced.

SUMMARY OF THE INVENTION

Therefore, it is an object of the present invention to provide an improved accumulator fuel injection device.

According to one aspect of the present invention, an accumulator fuel injection device for injecting an accumulated high-pressure fuel toward a cylinder of an internal combustion engine, comprises a control piston for controlling opening and closing of a fuel injection hole. A pressure control chamber urges the control piston in a fuel injection hole closing direction using fuel pressure supplied from a high-pressure fuel passage. A restrictor hole is formed between a low-pressure space and the pressure control chamber. A solenoid valve controls communication between the low-pressure space and the pressure control chamber. The solenoid valve comprises a substantially flat valve seat formed with the restrictor hole. A valve member is capable of a tight plane contact with the flat valve seat. A annular groove passage is on the flat valve seat and communicates with the low-pressure space in a tight contact region between the flat valve seat and the valve member. A wall separating the annular groove passage and the restrictor hole from each other has a thickness smaller than an inner diameter of the restrictor hole.

According to another aspect of the present invention, an accumulator fuel injection device for injecting an accumulated high-pressure fuel toward a cylinder of an internal combustion engine comprises a control piston for controlling opening and closing of a fuel injection hole. A pressure control chamber for urges the control piston in a fuel injection hole closing direction using fuel pressure supplied from a high-pressure fuel passage. A restrictor is hole formed between a low-pressure space and the pressure control chamber. A solenoid valve controls communication between the low-pressure space and the pressure control chamber. The solenoid valve comprises a substantially flat valve seat formed with the restrictor hole. A valve member capable of a tight plane contact with the flat valve seat. Biasing means bias the valve member to the flat valve seat. A solenoid, when energized, attracts the valve member in a direction separated from the flat valve seat. A fuel relief passage formed on one of the flat valve seat and the valve member and communicates with the low-pressure space in a tight contact region between the flat valve seat and the valve member. The fuel relief passage includes an annular groove passage formed essentially concentric with the restrictor hole and at least one fuel passage having one end communicating with the annular groove passage and another end communicating with the low-pressure space. A wall separating the annular groove passage and the restrictor hole from each other has a thickness smaller than an inner diameter of the restrictor hole.

It may be arranged such that the annular groove passage gradually increases in depth from an innermost side thereof to an outward side thereof.

It may be arranged such that, when the valve member is seated on the flat valve seat, the valve member is in a tight plane contact with the flat valve seat at inner and outer sides thereof relative to the annular groove passage.

It may be arranged such that the valve member includes a spherical member capable of the tight plane contact with the flat valve seat and having a spherical convex surface, and a shaft member having one of a spherical concave surface, a conical concave surface and a planar surface for abutting the spherical convex surface in an axial direction thereof. The shaft member slidably supports the spherical member.

It may be arranged that a planar surface of the spherical member capable of the tight plane contact with the flat valve seat is formed by cutting a portion of a steel ball through postprocessing.

It may be arranged that the valve member has a support member mounted on the shaft member to prevent the spherical member from falling off by means of one of caulking, reduction in inner diameter and a projection.

It may be arranged that the valve member includes a cylindrical support member provided at an end portion of the shaft member the spherical member to prevent from falling off by caulking a tip portion of the support member after receiving therein the spherical member.

It may be arranged that an inner diameter of the annular groove passage is set no more than 1.0 mm.

It may be arranged that a further restrictor hole is provided between the high-pressure fuel passage and the pressure control chamber for regulating a flow of fuel into the pressure control chamber. The further restrictor hole has passage resistance greater than that of the aforementioned restrictor hole.

It may be arranged that the at least two fuel passages are provided and arranged symmetrically with respect to the restrictor hole.

It may be arranged that the biasing means is provided between the solenoid and the flat valve seat, the biasing means being a spring member receiving the valve member therethrough.

According to another aspect of the present invention, in an accumulator fuel injection system in which high-pressure fuel accumulated in a common rail is supplied to a fuel injector provided for each cylinder of a diesel internal combustion engine so as to inject the fuel into the corresponding cylinder through an injection nozzle of the fuel injector, the fuel injector comprises a nozzle needle for controlling communication between a high-pressure fuel passage capable of feeding the high-pressure fuel to an injection hole of the injection nozzle and the injection hole. As control piston is provided at a side of the nozzle needle remote from the injection hole so as to be movable backward and forward along with the nozzle needle. A solenoid valve is provided at a side of the control piston remote from the injection hole so as to control communication between a pressure control chamber and a low-pressure space. The pressure control chamber is capable of urging the control piston in a direction to close the injection hole by means of fuel pressure supplied from the high-pressure fuel passage. A first restrictor hole is provided between the high-pressure fuel passage and the pressure control chamber for regulating a flow of the fuel into the pressure control chamber. A second restrictor hole is provided between the pressure control chamber and the low-pressure space and has a passage resistance smaller than that of the first restrictor hole. The solenoid valve comprises a substantially flat valve seat formed with the second restrictor hole, a valve member capable of a tight plane contact with the flat valve seat, biasing means for biasing the valve member to the flat valve seat, and a solenoid attracting, when energized, the valve member in a direction separated from the flat valve seat. When the valve member is seated on the flat valve seat to achieve the tight plane contact therebetween, communication between the pressure control chamber and the low-pressure space is prohibited, wherein. When the valve member is separated from the flat valve seat, communication between the pressure control chamber and the low-pressure space is established. A fuel relief passage is formed on one of the flat valve seat and the valve member, the fuel relief passage communicating with the low-pressure chamber in a tight contact region between the flat valve seat and the valve member. The fuel relief passage includes an annular groove passage formed essentially concentric with the second restrictor hole and at least one fuel passage having one end communicating with the annular groove passage and another end communicating with the low-pressure space. A thickness of a wall separating the annular groove passage and the second restrictor hole from each other is set smaller than an inner diameter of the second restrictor hole.

According to another aspect of the present invention, an accumulator fuel injection device for injecting an accumulated high-pressure fuel toward a cylinder of an internal combustion engine, comprises a control piston for controlling opening and closing of a fuel injection hole. A pressure control chamber for urges the control piston in a fuel injection hole closing direction using fuel pressure supplied from a high-pressure fuel passage. A restrictor hole is formed between a low-pressure space and the pressure control chamber. A solenoid valve for controls communication between the low-pressure space and the pressure control chamber. The solenoid wherein the solenoid valve comprises a flat valve seat formed with the restrictor hole. A valve member is capable of a tight plane contact with the flat valve seat. An annular groove passage is formed on the flat valve seat and communicates with the low-pressure space in a tight contact region between the flat valve seat and the valve member. An inner diameter of the annular groove passage is set greater than an inner diameter of the restrictor hole and no greater than 1.0 mm.

According to another aspect of the present invention, in an accumulator fuel injection system in which high-pressure fuel accumulated in a common rail is supplied to a fuel injector provided for each cylinder of a diesel internal combustion engine so as to inject the fuel into the corresponding cylinder through an injection nozzle of the fuel injector, the fuel injector comprises a nozzle needle for controlling communication between a high-pressure fuel passage capable of feeding the high-pressure fuel to an injection hole of the injection nozzle and the injection hole. A control piston is provided at a side of the nozzle needle remote from the injection hole so as to be movable backward and forward along with the nozzle needle. A solenoid valve is provided at a side of the control piston remote from the injection hole so as to control communication between a pressure control chamber and a low-pressure space. The pressure control chamber is capable of urging the control piston in a direction to close the injection hole by means of fuel pressure supplied from the high-pressure fuel passage. A first restrictor hole is provided between the high-pressure fuel passage and the pressure control chamber for regulating a flow of the fuel into the pressure control chamber. A second restrictor hole is provided between the pressure control chamber and the low-pressure space and has a passage resistance smaller than that of the first restrictor hole. The solenoid valve comprises a flat valve seat formed with the second restrictor hole. A valve member is capable of a tight plane contact with the flat valve seat. Biasing means for bias the valve member to the flat valve seat. A solenoid attracts, when energized, the valve member in a direction separated from the flat valve seat. When the valve member is seated on the flat valve seat to achieve the tight plane contact therebetween, communication between the pressure control chamber and the low-pressure space is prohibited. When the valve member is separated from the flat valve seat, communication between the pressure control chamber and the low-pressure space is established. A fuel relief passage is formed on one of the flat valve seat and the valve member. The fuel relief passage communicates with the low-pressure chamber in a tight contact region between the flat valve seat and the valve member. The fuel relief passage includes an annular groove passage formed essentially concentric with the second restrictor hole and at least one fuel passage having one end communicating with the annular groove passage and another end communicating with the low-pressure space. An inner diameter of the annular groove passage is set no greater than 1.0 mm.

BRIEF DESCRIPTION OF THE DRAWINGS

The present invention will be understood more fully from the detailed description given hereinbelow, taken in conjunction with the accompanying drawings.

In the wings:

FIGS. 2A and 2B are diagrams showing a flat plate incorporated in the accumulator fuel injection device according to the first preferred embodiment, wherein FIG. 2A is a plan view and FIG. 2B is a sectional view teen along line B—B in FIG. 2A;

FIGS. 7A and 7B are diagrams showing a flat plate according to a second preferred embodiment of the present invention, wherein FIG. 7A is a plan view and FIG. 7B is a sectional view taken along line B—B in FIG. 7A;

FIGS. 8A and 8B are diagrams showing a flat plate according to a third preferred embodiment of the present invention, wherein FIG. 8A is a plan view and FIG. 8B is a sectional view taken along line B—B in FIG. 8A FIGS. 9A and 9B are diagrams showing a flat plate according to a fourth preferred embodiment of the present invention, wherein

FIGS. 10A and 10B are diagrams showing a flat plate according to a fifth preferred embodiment of the present invention, wherein FIG. 10A is a plan view and FIG. 10B is a sectional view taken along line B—B in FIG. 10A;

FIGS. 11A and 11B are diagrams showing a flat plate according to a sixth preferred embodiment of the present invention, wherein FIG. 11A is a plan view and FIG. 11B is a sectional view taken along line B—B in FIG. 11A FIGS. 12A and 12B are diagrams showing a valve shaft and a spherical member according to a seventh preferred embodiment of the present invention, wherein

FIGS. 13A and 13B are diagrams showing a flat plate according to the seventh preferred embodiment, wherein FIG. 13A is a plan view and FIG. 13B is a sectional view taken along line B—B in FIG. 13A;

DESCRIPTION OF THE PREFERRED EMBODIMENT

Now, preferred embodiments of the present invention will be described hereinbelow with reference to the accompanying drawings.

(First Embodiment)

FIGS. 1 to 4 show a fuel injection device according to a first preferred embodiment of the present invention.

Figure 4:
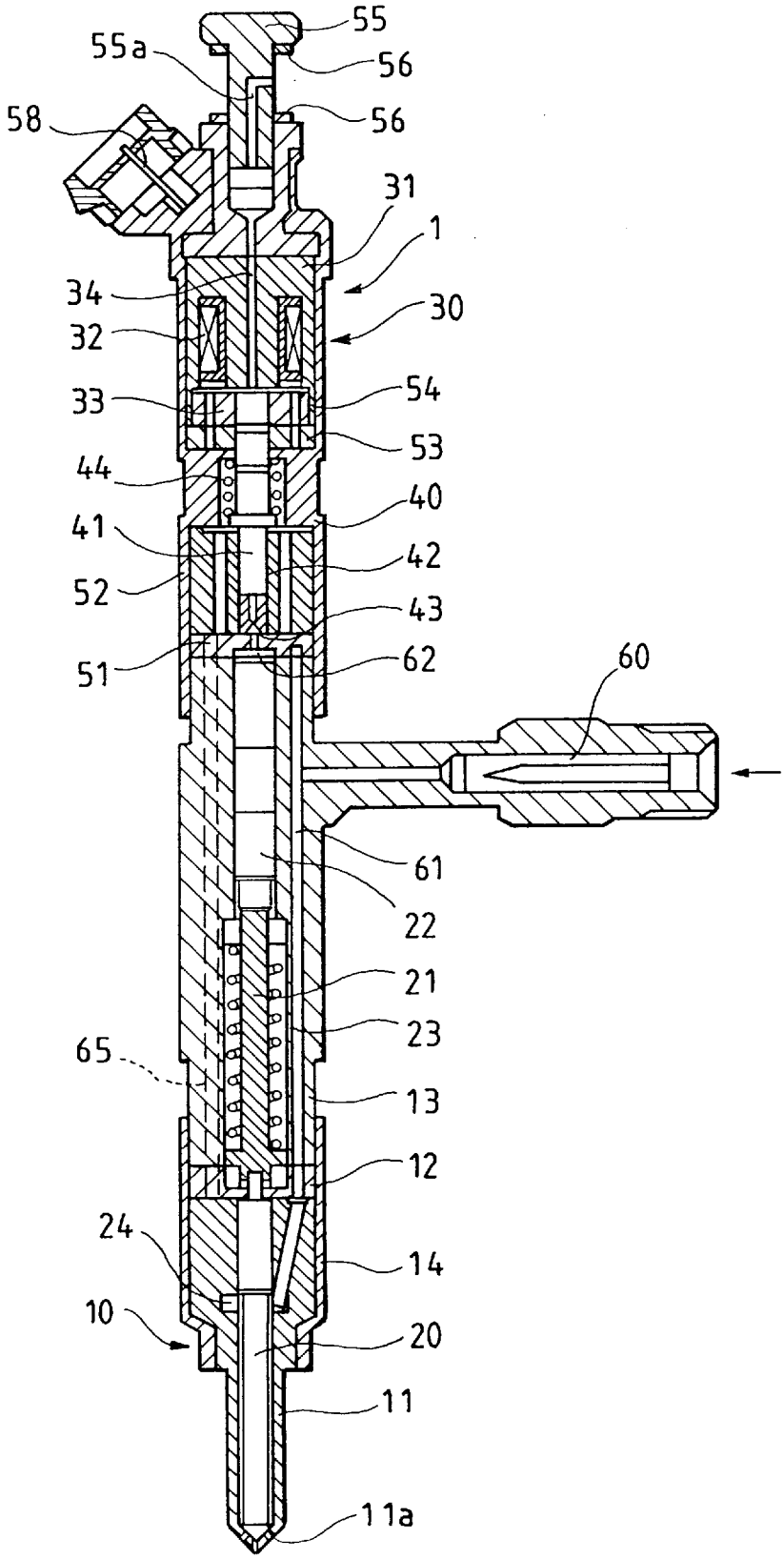
FIG. 4 is a sectional view showing the accumulator fuel injection device according to the first preferred embodiment.

In FIG. 4, an injector 1 is supplied with the accumulated high-pressure fuel of a constant pressure from a common rail (not shown) via a fuel pipe arrangement and a fuel filter 60.

The injector 1 has an injection nozzle 10 at an injection side end thereof. A nozzle body 11 of the injection nozzle 10 receives therein a nozzle needle 20 which is movable backward and forward in the nozzle body 11 so as to open and close injection holes 11*a*. The nozzle needle 20 is of a stepped shape having a step between a larger-diameter portion and a smaller-diameter portion. The nozzle body 11 and an injector body 13 coupled together by means of a retaining nut 14, with a distance piece 12 interposed therebetween. At a side of the nozzle needle 20 remote from the injection holes 11*a*, a pressure pin 21 and a control piston 22 abutting or coupled to the pressure pin 21 at a side remote from the injection holes 11*a* are arranged. The pressure pin 21 extends through a spring 23 which biases the pressure pin 21 downward in FIG. 4. A pressure control chamber 62 is provided at a side of the control piston 22 remote from the injection holes 11*a*.

The high-pressure fuel introduced into a high-pressure fuel passage 61 via the fuel filter 60 is fed to an annular fuel sump 24 provided around the nozzle needle 20 at the foregoing step thereof and to the pressure control chamber 62. The pressure of the high-pressure fuel within the fuel sump 24 urges the nozzle needle 20 in a lifting direction, that is, in a valve opening direction. On the other hand, the pressure of the high-pressure fuel within the pressure control chamber 62 urges the control piston 22 downward in FIG. 3.

A solenoid valve 30 is in the form of a two way solenoid valve for allowing or prohibiting communication between the pressure control chamber 62 and a low pressure side. A flat plate 51 working as a planar spring seat and a cylinder 52 are coupled to the injector body 13 by means of a retaining nut 40. Further, a core 31 of the solenoid valve 30 is caulked at an end of the retaining nut 40.

A solenoid 32 is wound in the core 31 and given the electric power through a connector 58. A low-pressure fuel passage 34 is formed in the core 31. Further, a low-pressure fuel passage 55*a* is formed in a screw nut 55 so as to communicate with the fuel passage 34. Excess fuel in the injector 1 is discharged through the low-pressure fuel passages 34 and 55*a*. Gaskets 56 are fitted onto the screw nut 55.

A low-pressure fuel passage 65 is provided for recovering leakage fuel from sliding clearances around the control piston 22 and the nozzle needle 20. The fuel passage 65 communicates with a low-pressure fuel passage 52*a*.

Figure 3:
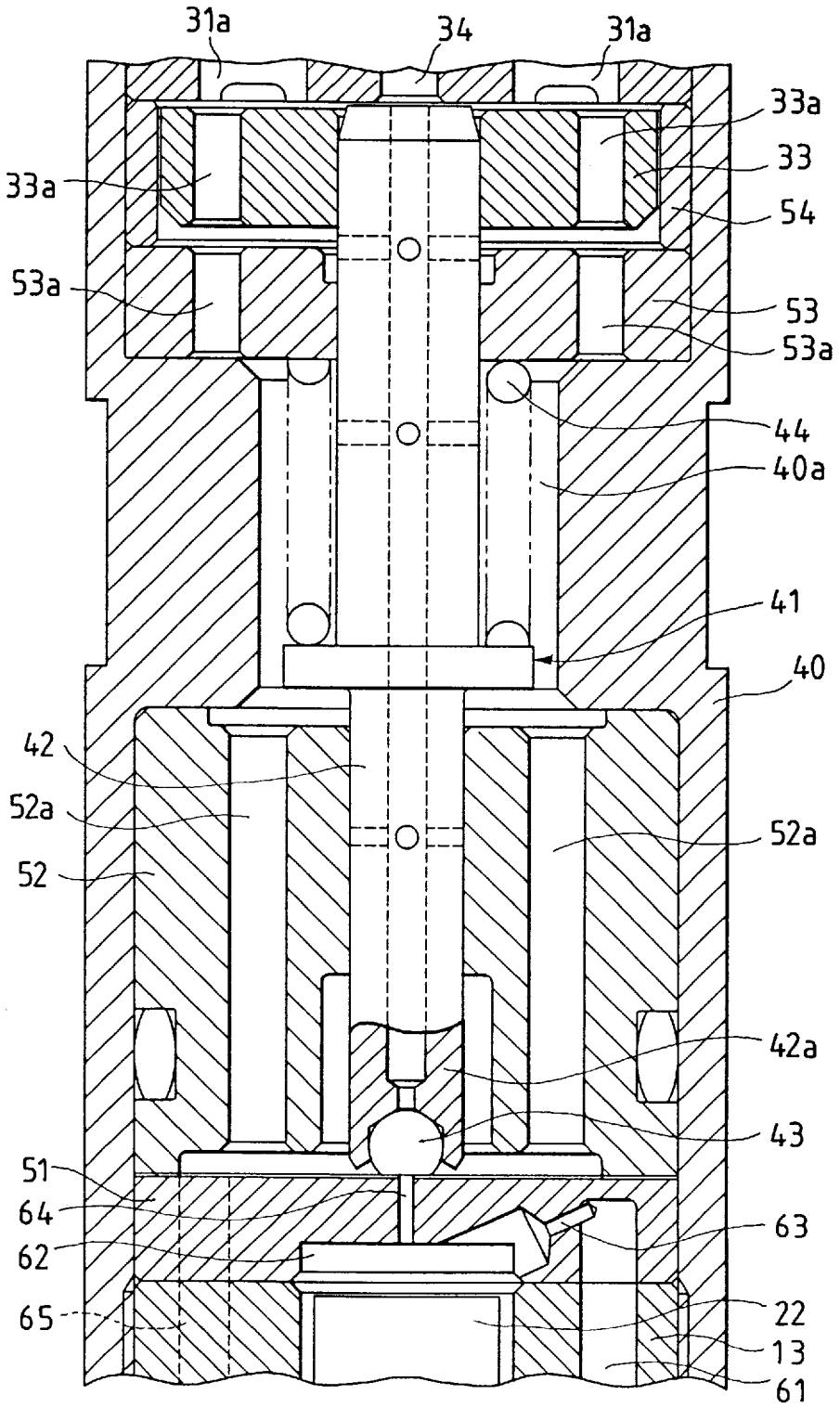
FIG. 3 is a sectional view showing the main portion of the accumulator fuel injection device according to the first preferred embodiment.

As shown in FIG. 3, a valve member 41 of the solenoid valve 30 includes a valve shaft 42 and a spherical member 43. The shaft 42 is supported on an inner wall of the cylinder 52 so as to be movable backward and forward, while the spherical member 43 is slidably supported at a tip of the shaft 42. An armature 33 is fixed to the shaft 42 at a side near the solenoid 32. While the solenoid 32 is deenergized, the spherical member 43 is seated on the flat plate 51 due to a biasing force of a spring 44 whose one end engages with a stopper 53. On the other hand, while the solenoid 32 is energized, the armature 33 is attracted toward the solenoid 32 due to a magnetic force generated at the solenoid 32. Thus, the shaft 42 is lifted upward in FIG. 3 so that the spherical member 43 is separated from the flat plate 51. By changing a length of a spacer 54, the lift magnitude of the valve member 41 can be adjusted.

The high-pressure fuel passage 61 communicates with the pressure control chamber 62 via a first restrictor hole 63 which regulates the fuel flow from the high-pressure fuel passage 61 to the pressure control chamber 62. The flat plate 51 is formed with a second restrictor hole 64, as a communication passage, having a passage resistance smaller than the first restrictor hole 63 and extending axially through the flat plate 51. When the valve member 41 separates from the flat plate 51, the second restrictor hole 64 communicates with the low-pressure fuel passage 52*a*. Thus, the high-pressure fuel in the pressure control chamber 62 is discharged from the injector 1 via the second restrictor hole 64, the low-pressure fuel passage 52*a*, the low-pressure fuel chamber 40*a*, and the low-pressure fuel passages 53*a*, 31*a*, 34 and 55*a*.

Figure 1:
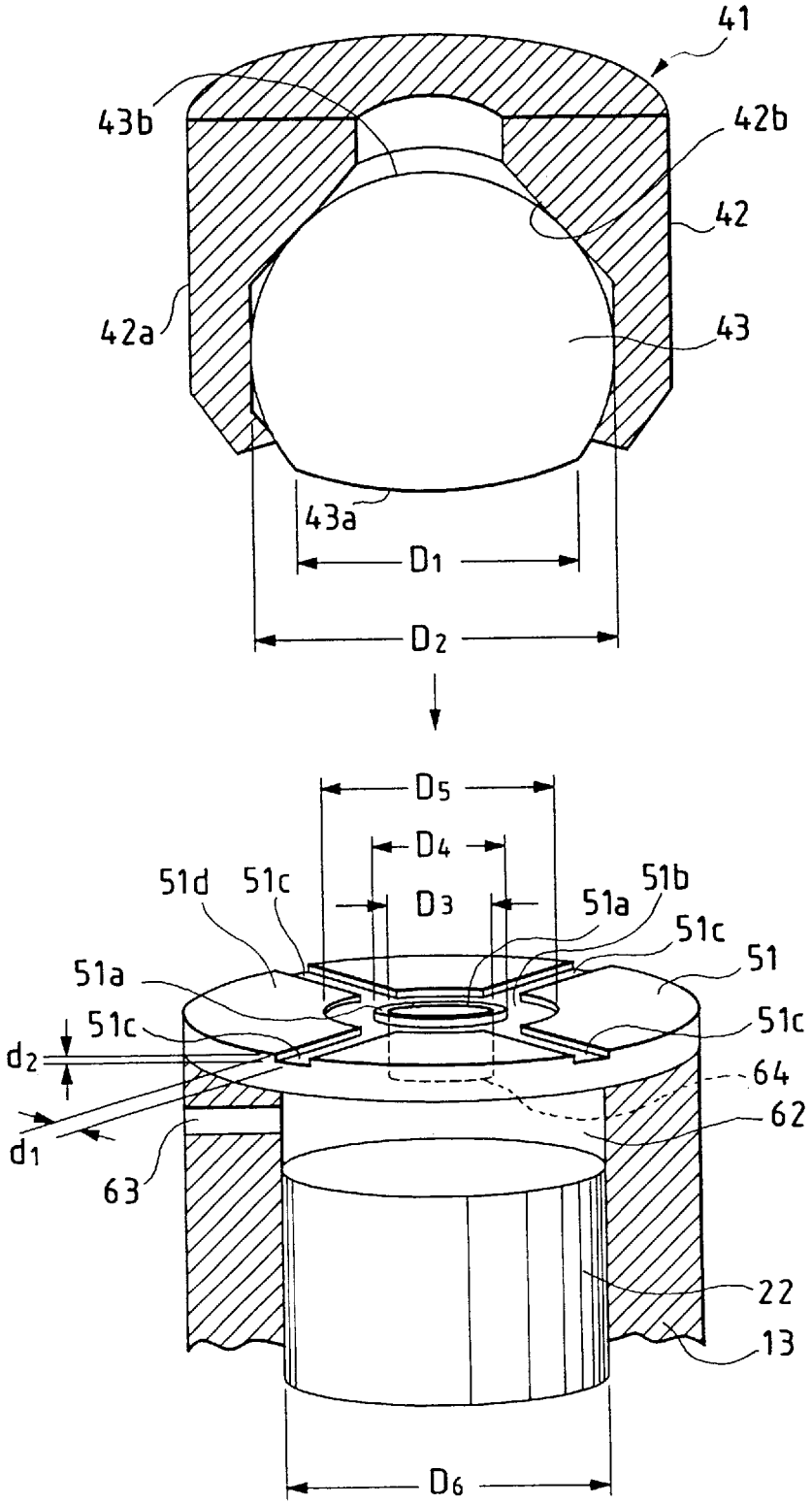
FIG. 1 is a diagram showing the main portion of a solenoid valve incorporated in an accumulator fuel injection device according to a first preferred embodiment of the present invention.

As shown in FIG. 1, the shaft 42 is formed at its tip with a concave portion of a truncated cone formed by a cylindrical inner wall and a conical concave surface 42*b* of a cylindrical portion 42*a* which works as a support member. By caulking a tip portion of the cylindrical portion 42*a*, the spherical member 43 is prevented from falling off the shaft 42. Since a clearance of several microns is formed between the cylindrical portion 42*a* and the spherical member 43, the spherical member 43 is slidable relative to the shaft 42. The spherical member 43 is formed by cutting a portion of a steel ball through postprocessing. On the other hand, it may be formed by grinding.

Figure 2A:
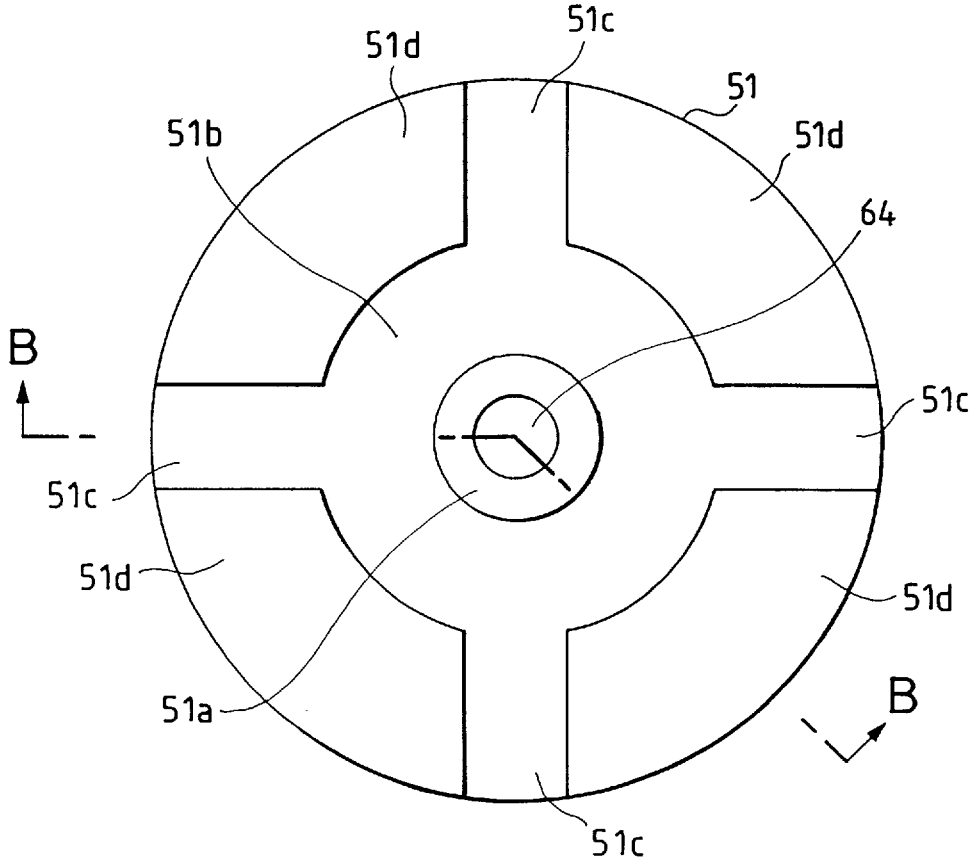
Figure 2B:
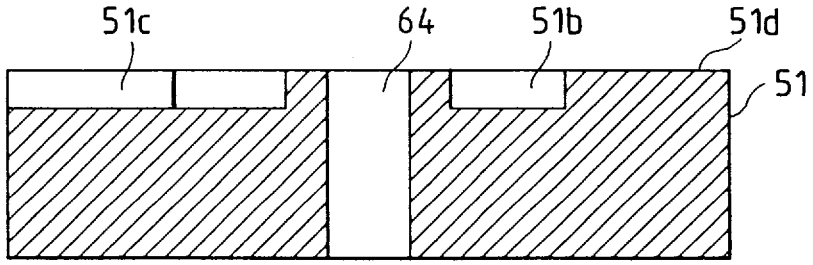

As shown in FIGS. 1 and 2, on an upper surface of the flat plate 51 is formed an annular seat face 51*a* around an opening of the second restrictor hole 64. Around the annular seat face 51*a* is formed an annular groove by means of which an annular groove passage 51*b* is formed. Four grooves are formed extending radially outward from the annular groove so as to provide essentially cross-shaped grooves by means of which fuel groove passages 51*c* are formed. One end of each of the fuel groove passages 51*c* communicates with the annular groove passage 51*b*, while the other end thereof communicates with the low-pressure fuel passage 52*a*. The annular groove passage 51*b* and the fuel groove passages 51*c* form fuel relief passages. The fuel relief passages are arranged to communicate with the low-pressure fuel passage 52*a* even in the state where the spherical member 43 is seated on the flat plate 51. Four fan-shaped seat faces 51*d* are defined by the annular groove passage 51*b* and the fuel groove passages 51*c*.

A planar portion 43*a* of the spherical member 43 is seatable on the seat face 51*a* and portions of the seat faces 51*d* when the solenoid valve 30 is closed. As appreciated, the seat face 51*a* is on a level with the seat faces 51*d*. When the spherical member 43 is seated on the flat plate 51, communication between the second restrictor hole 64 and the annular groove passage 51*b* is interrupted.

In this embodiment, a thickness of the seat face 51*a* as measured along a diameter thereof is set smaller than a diameter D3 of the second restrictor hole 64, that is, D3>(D4-D3)/2, wherein D4 represents an inner diameter of the annular groove passage 51*b*.

A specific example of various dimensions shown in FIG. 1 will be given hereinbelow.

D1 (diameter of planar portion 43*a*)=1.43 mm, D2 (diameter of spherical member 43)=2.0 mm, D3 (diameter of second restrictor hole 64)=0.4 mm, D4 (inner diameter of annular groove passage 51*b*)=0.5 mm, D5 (outer diameter of annular groove passage 51*b*)=1.0 mm, D6 (diameter of control piston 22)=4.5 mm, d1 (width of fuel groove passage 51*c*)=0.4 mm, d2 (depth of fuel groove passage 51*c*)=0.1 mm, and a cutting width of the spherical member 43=0.3 mm.

Now, an operation of the fuel injection device will be described hereinbelow.

(1) The high-pressure fuel is introduced into the high-pressure fuel passage 61 of the injector 1 from the common rail via the fuel arrangement. The high-pressure fuel is then supplied to the fuel sump 24 and the pressure control chamber 62. While the solenoid 32 is deenergized, since the spherical member 43 is seated on the flat plate 51, communication between the second restrictor hole 64 and the low-pressure fuel passage 52 is prohibited. At this instant, it can be considered that the fuel pressure in the pressure control chamber 62 and the fuel pressure in the fuel sump 24 are equal to each other. Since D6 (diameter of control piston 22)=5.0 mm as identified above, and diameters of the larger-diameter and smaller-diameter portions of the nozzle needle 20 are set to 4.0 mm and 2.25 mm, respectively, a difference between a pressure receiving area of the control piston 22 subjected to a force in a nozzle closing direction due to the fuel pressure in the pressure control chamber 62 and a pressure receiving area of the nozzle needle 20 subjected to a force in a nozzle opening direction due to the fuel pressure in the fuel sump 24 is about 11 $mm^2$. Thus, if the fuel pressures in the fuel sump 24 and the pressure control chamber 62 are equal to each other, the sum of the hydraulic loads applied to the nozzle needle works in the nozzle closing direction. Further, the pressure pin 21 is biased in the nozzle closing direction due to the spring 23. Accordingly, while the solenoid 32 is deenergized, the nozzle needle 20 closes the injection holes 11*a* so that no fuel is injected from the injector 1.

Even in a period immediately after the engine start-up where the pressure of fuel fed to the injector 1 is not sufficiently increased, while the solenoid 32 is deenergized, the nozzle needle 20 closes the injection holes 11*a* so that no fuel injection is performed from the injector 1.

The load of the spring 44 urging the valve member 41 toward the flat plate 51 is set to 30N to 40N. On the other hand, if, for example, the fuel pressure in the pressure control chamber 62 is 150 MPa, the maximum hydraulic load applied to the valve member 41 in a solenoid valve opening direction becomes 24N. Thus, the solenoid valve 30 is not opened even when the maximum hydraulic load is applied.

(2) When the solenoid 32 is energized in this state, the armature 33 is attracted toward the solenoid 32 due to the generated magnetic force. When the sum of this magnetic force and a force produced by the fuel pressure in the pressure control chamber 62 applied to the pressure receiving portion of the spherical member 43 so as to urge the valve member 41 in the solenoid valve opening direction, becomes greater than the set load of the spring 44 urging the valve member 41 in the solenoid valve closing direction, the spherical member 43 is separated from the flat plate 51 so that the solenoid valve 30 is opened. In this embodiment, the foregoing magnetic force is set to about 50N. When the solenoid valve 30 is opened, the fuel in the pressure control chamber 62 flows out into the low-pressure fuel chamber 40*a* via the second restrictor hole 64 and the low-pressure fuel passage 52*a*, and then introduced into a pipe arrangement (not shown) for recovering the leakage fuel via the low-pressure fuel passages 53*a*, 33*a*, 34 and 55*a*.

After a while from the start of the high-pressure fuel flowing out of the pressure control chamber 62, the pressure in the pressure control chamber 62 becomes lower relative to the pressure in the high-pressure fuel passage 61. This is because the passage area of the first restrictor hole 63 for regulating the fuel introduced into the pressure control chamber 62 is set smaller than the passage area of the second restrictor hole 64 for regulating the fuel flowing out from the pressure control chamber 62 so that the passage resistance of the second restrictor hole 64 is smaller than that of the first restrictor hole 63. When the pressure in the pressure control chamber 62 is further lowered, the hydraulic load applied to the nozzle needle 20 in the nozzle opening direction overcomes the sum of the hydraulic load applied to the control piston 22 in the nozzle closing direction and the set load of the spring 23. Thus, the nozzle needle 20 is lifted up to start the fuel injection through the injection holes 11*a*.

When the solenoid 32 is deenergized at a given fuel injection termination timing, the magnetic force for attracting the armature 33 becomes zero. Thus, due to the biasing force of the spring 44, the spherical member 43 is seated on the flat plate 51 so that the solenoid valve 30 is closed. Then, since the high-pressure fuel is introduced into the pressure control chamber 62 from the high-pressure fuel passage 61, the pressure in the pressure control chamber 62 is gradually increased. When the sum of the hydraulic load applied to the nozzle needle 20 in the nozzle closing direction and the set load of the spring 23 overcomes the hydraulic load applied to the nozzle needle 20 in the nozzle opening direction, the nozzle needle 20 closes the injection holes 11*a* so that the injection nozzle 10 is closed to finish the fuel injection.

Now, an advantage of providing the foregoing fuel relief passages will be described hereinbelow.

Figure 5A:
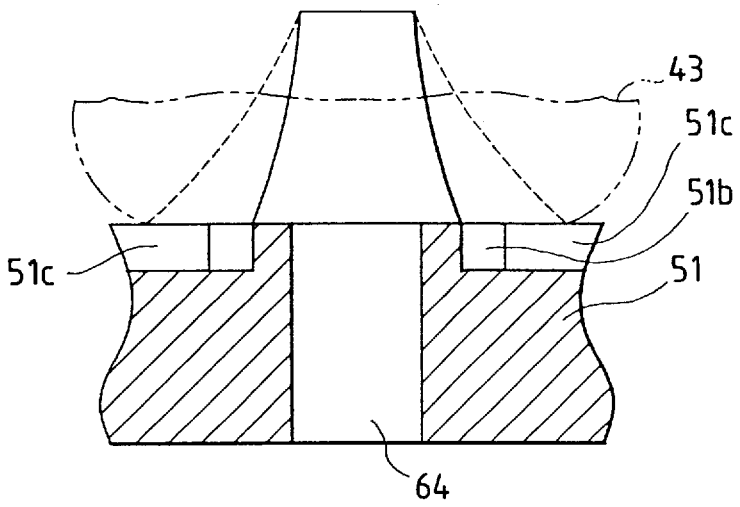
FIG. 5A is a characteristic diagram showing a positional relationship between pressure distributions with and without fuel relief passages and a seat portion of the solenoid valve, wherein solid line represents the pressure distribution with the fuel relief passages and dotted line represents the pressure distribution without the fuel relief passages.
Figure 5B:
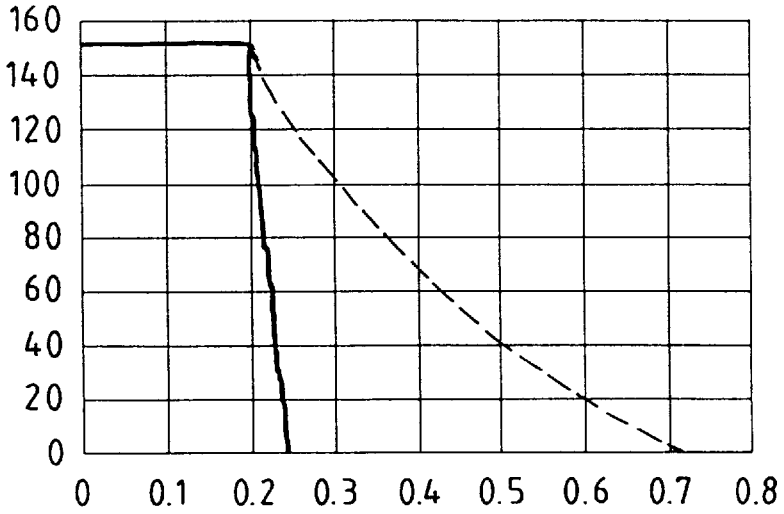
FIG. 5B is a characteristic diagram showing a relationship between the pressure distributions with and without the fuel relief passages and distances in a radial direction of the seat portion of the solenoid valve, wherein solid line represents the pressure distribution with the fuel relief passages and dotted line represents the pressure distribution without the fuel relief passages.
Figure 6:
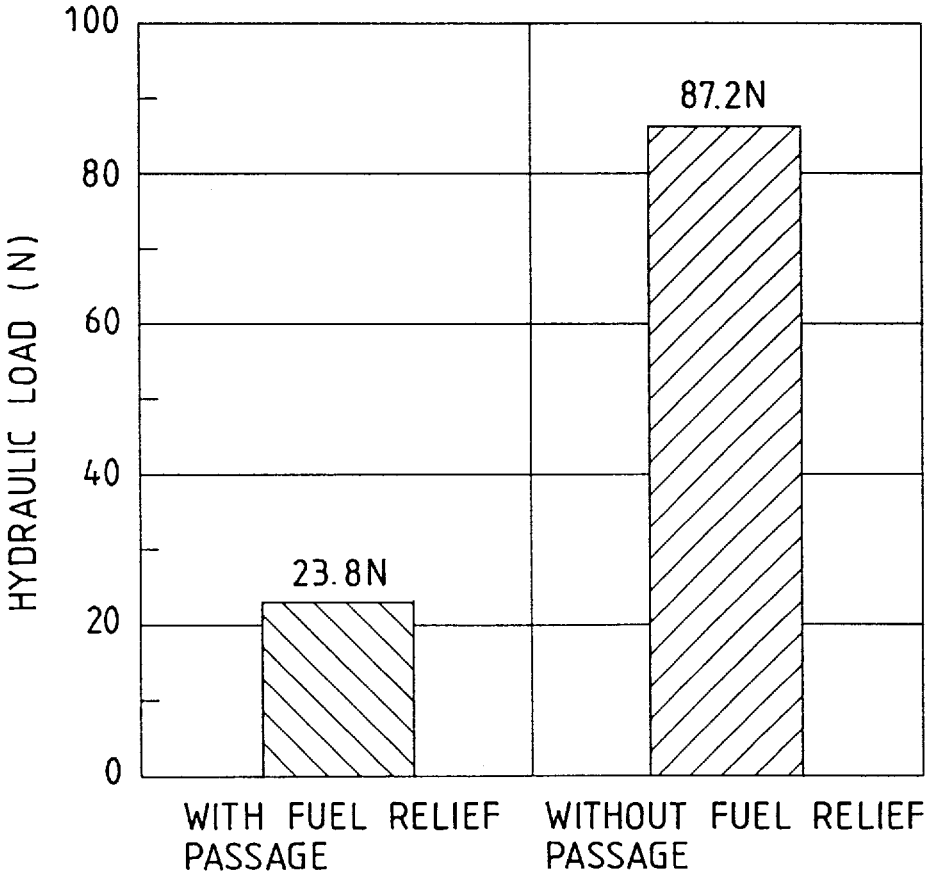
FIG. 6 is a characteristic diagram showing hydraulic loads with and without the fuel relief passages.

FIG. 5A shows pressure distributions applied to the planar portion 43*a* of the spherical member 43 due to the high-pressure fuel in the pressure control chamber 62, wherein the solid line represents the pressure distribution with the annular groove passage 51*b* and the fuel groove passages 51*c*, that is, with the fuel relief passages, and the dotted line represents the pressure distribution without the fuel relief passages. FIG. 5B shows theoretical values of the pressure distributions relative to the distances in the radial direction of the planar portion 43*a* of the spherical member 43, wherein the solid line represents the theoretical values of the pressure distribution with the fuel relief passages, and the dotted line represents the theoretical values of the pressure distribution without the fuel relief passages. The theoretical values are derived using the foregoing values for the dimensions shown in FIG. 1. FIG. 6 shows values each of which is derived by integrating, all over the planar portion 43*a*, the hydraulic loads applied to the planar portion 43*a* in the solenoid valve opening direction when the corresponding pressure distribution shown in FIG. 5B is applied.

While the solenoid valve 30 is closed to seal the high-pressure fuel, the high-pressure fuel leaks into a tight contact region between the flat plate 51 and the planar portion 43*a* of the spherical member 43 with a certain pressure distribution. In this embodiment, since the annular groove passage 51*b* and the fuel groove passages 51*c* formed in this tight contact region, that is, on the flat plate 51, communicate with the low-pressure fuel passage 52*a*, the pressure in the annular groove passage 51*b* and the fuel groove passages 51*c* is lowered to the pressure in the low-pressure fuel passage 52*a* (drain pressure≈0). Thus, as shown in FIG. 5A by the solid line, the pressure distribution in this embodiment becomes a known pressure distribution which is represented by the gap flow between parallel discs derived by connecting from the second restrictor hole 64 to the annular groove passage 51*b* using a logarithmic function.

On the other hand, in case of the conventional injector having none of the annular groove passage 51*b* and the fuel groove passages 51*c* communicating with the low-pressure fuel passage 52*a*, since the pressure is finally lowered to the drain pressure only at the outer peripheral edge of the planar portion of the spherical member as shown in FIG. 5A by the dotted line. Thus, the pressure distribution in the conventional injector becomes long in the radial direction of the planar portion.

It is seen from FIG. 6 that the hydraulic force generated in the solenoid valve opening direction when the fuel relief passages are provided can be reduced by more than 70% as compared with that without any no fuel relief passages. Thus, the biasing force of the spring 44 urging the valve member 41, in the solenoid valve closing direction can be set smaller. Further, since the magnetic force of the solenoid 32 for lifting the valve member 41 against the biasing force of the spring 44 can also be set smaller, the solenoid valve can be reduced in size.

The foregoing effect can also be achieved by reducing the diameter of either of the planar portion 43*a* of the spherical member and the flat plate 51. However, if the seating area of the solenoid valve is extremely reduced by reducing the diameter of either of the planar portion 43*a* and the flat plate 51, the seat face pressure is extremely increased. Thus, although the initial performance can be achieved well, there rises a problem in durability which is not suitable from a practical point of view. The foregoing effect can also be achieved when a gap between the spherical member 43 and the flat plate 51 is extremely small immediately before the solenoid valve is closed.

In this embodiment, since the annular groove passage 51*b* and the fuel groove passages 51*c* are arranged in point symmetry with respect to the second restrictor hole 64, the pressures applied to the planar portion 43*a* are distributed in a symmetrical shape. Specifically, since the symmetrical pressure distribution can be achieved radially outward from the center of the planar portion 43*a*, inclination or eccentricity of the spherical member 43 is not generated upon opening and closing of the solenoid valve so that the reliable opening/closing control of the solenoid valve can be ensured.

Further, in this embodiment, the spherical member 43 having a spherical convex surface is slidably received in the truncated cone-shaped concave portion of the shaft 42, and the planar portion 43*a* of the spherical member 43 is seated on the flat plate 51. Thus, the axial offset upon seating of the planar portion 43*a* can be absorbed so that the reliable sealing by the spherical member 43 is ensured between the pressure control chamber 62 and the low-pressure side. Further, since the spherical member 43 is not displaced due to the fluid during operation of the solenoid valve 30, reliable control of the fluid can be achieved. Accordingly, this arrangement is not limited to the spherical member shown in this embodiment, but can also be applied to, for example, the tip shape of a ball valve.

Now, explanation will be added about the maximum value of the inner diameter D4 of the annular groove passage 51*b*.

Figure 21:
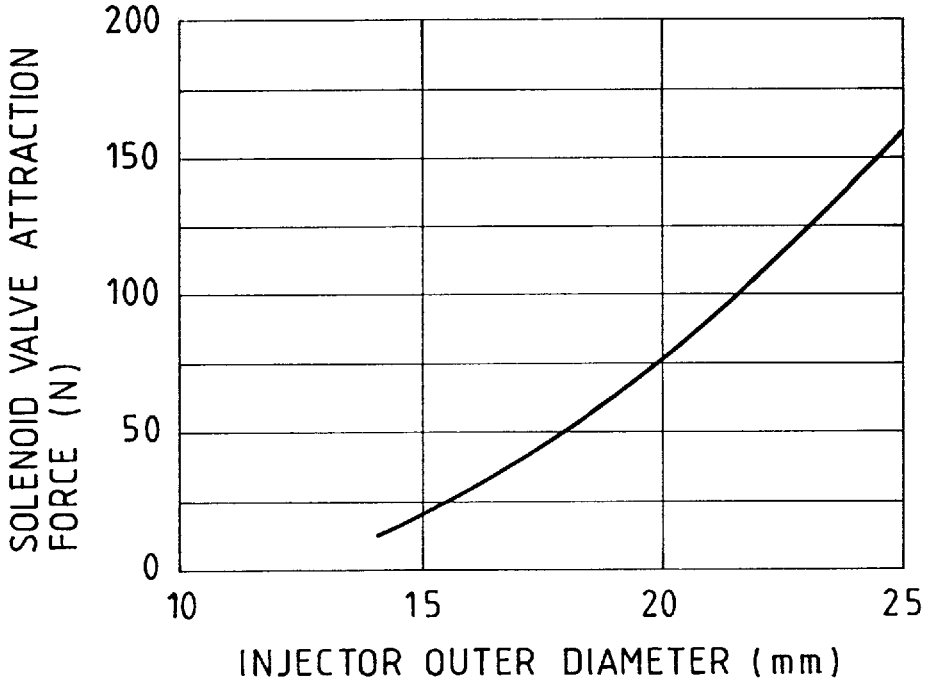
FIG. 21 is a diagram showing a relationship between a solenoid valve attraction force and an injector outer diameter.

Assuming that the injector is a small-sized injector for use in a passenger car, an outer diameter of the injector at a portion receiving therein the solenoid valve 30 is about 20 mm at maximum in view of the mounting space therefor. In this case, as shown in FIG. 21, the attraction force generated in the solenoid valve 30 is about 75N. FIG. 21 shows the result of theoretical calculation between the outer diameter of the injector and the attraction force of the solenoid valve. For opening the solenoid valve, the set load of the spring 44 should be no more than 75N and, in view of the valve opening response and the margin, it is necessary to set the load of the spring 44 no more than about 65N. Further, in view of reliably holding the closed state of the solenoid valve, the hydraulic load applied in the solenoid valve opening direction should be set no more than about 55N in view of the valve closing response and the margin.

Assuming that D3 (diameter of second restrictor hole 64)=0.4 mm, D4, which achieves the hydraulic load of 55N, is about 1 mm when calculated in the same manner as those values shown in FIG. 6. Thus, it is preferable that D4 is set to be greater than D3 and no more than 1 mm.

According to the foregoing first preferred embodiment, while the solenoid valve is closed or during the small lifting of the valve member which occurs immediately before the valve closing, the distribution of the pressures applied to the valve member 41 in the solenoid valve opening direction can be shortened in the radial direction. Thus, the attraction force of the solenoid for lifting the valve member 41 against the biasing force of the spring 44 can be set smaller so that the solenoid can be reduced in size. This is achieved without increasing the seat face pressure by means of the arrangement where the valve member 41 is allowed in tight contact with portions of the fan-shaped seat faces 51*d* in addition to the seat face 51*a*. Thus, the durability is not compromises deteriorated. Further, since the sealing of the high-pressure fuel during the closed state of the solenoid valve can be reliably achieved, the leakage of the high-pressure fuel can be reduced to lighten the load of the high-pressure pump for feeding the high-pressure fuel to the common rail. Thus, the high-pressure pump can be reduced in driving torque and further in size.

Further, since the uniform pressure distribution can be achieved with respect to the center axis of the spherical member 43, inclination or eccentricity of the spherical member 43 is not generated so that the stable opening/closing control of the solenoid valve can be ensured. This ensures the uniform fuel injection amount so that the reliable control of the amount injected can be realized. In particular, the small amount injection control can be stably achieved.

Further, since the axial offset upon seating of the spherical member can be absorbed, the tight contact between the spherical member and the flat plate can be reliably achieved so that the fuel leakage can be reduced to substantially zero upon seating of the spherical member. Thus, the leakage of the high-pressure fuel can be reduced.

(Second Embodiment)

Figure 7A:
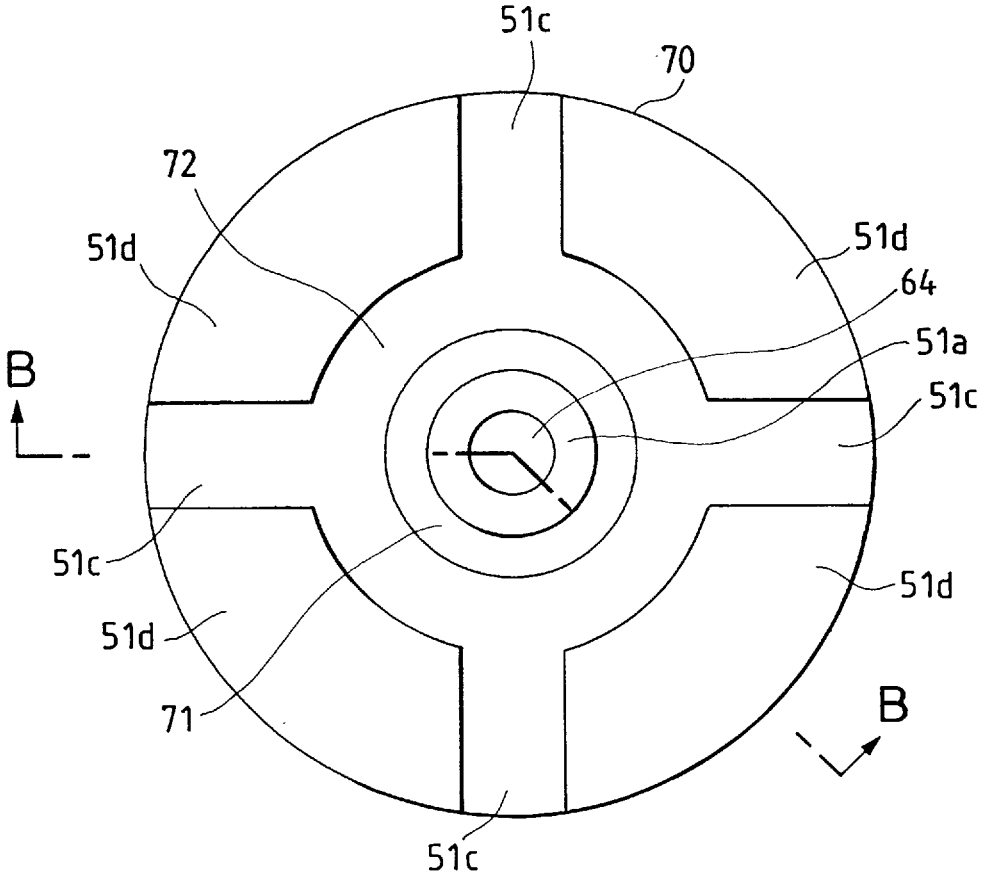
Figure 7B:
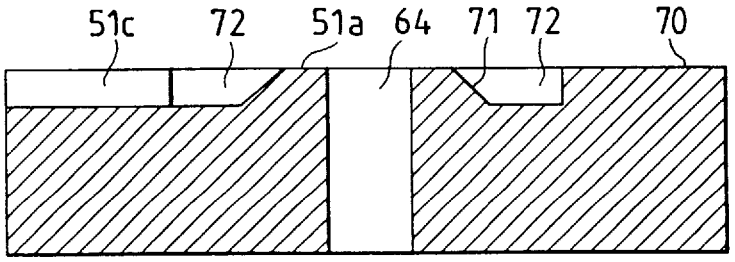

FIGS. 7A and 7B show a flat plate according to a second preferred embodiment of the present invention. Components which are essentially the same as those in the first preferred embodiment are assigned the same reference marks or symbols.

On a flat plate 70, a tapered surface 71 is formed following the outer peripheral edge of the annular seat face 51*a* so as to gradually increase the depth of an annular groove passage 72. The reason for this arrangement will be given hereinbelow.

Since the pressure in the pressure control chamber becomes no less than 1000 MPa, large force is applied to the seat face 51*a* near the second restrictor hole 64 so that elastic deformation may occur. Thus, by providing the tapered surface 71 following the outer peripheral edge of the seat face 51*a* so as to provide the large thickness near the second restrictor hole 64, the deformation of the seat face 51*a* can be suppressed so as to further ensure the sealing while the solenoid valve closed.

As a result of confirming the sealing property with the arrangement of the first preferred embodiment where no tapered surface is provided, a thickness of the seat face of no less than about 0.2 mm is required, as measured in the diameter direction, to ensure excellent sealing up to the fuel pressure of about 150 MPa in the pressure control chamber. If it is about 0.1 mm, then the tapered surface 71 is effective for ensuring such excellent sealing property.

(Third Embodiment)

Figure 8A:
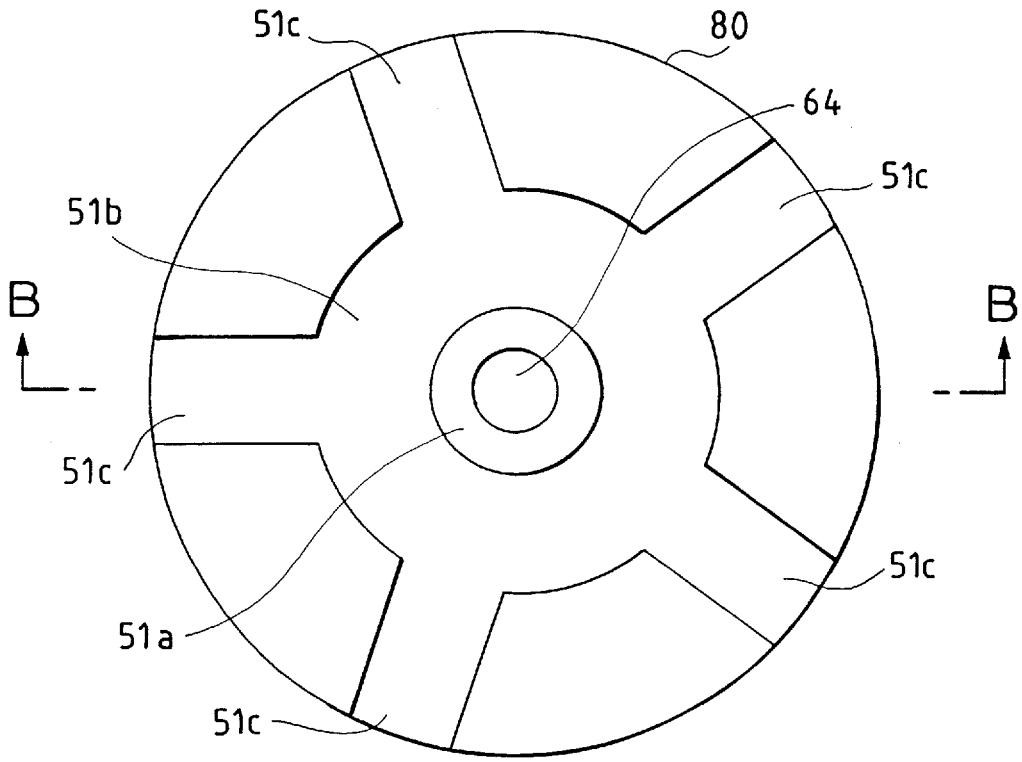
Figure 8B:
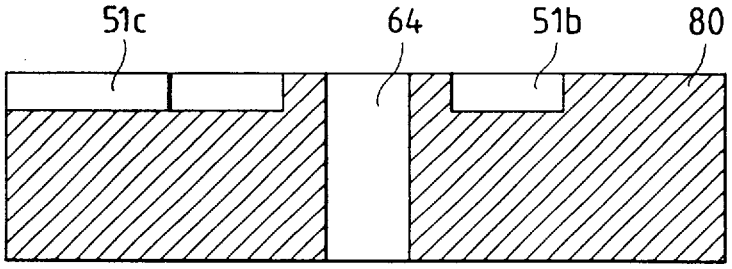

FIGS. 8A and 8B show a flat plate according to a third preferred embodiment of the present invention. Components which are essentially the same as those in the first preferred embodiment are assigned the same reference marks or symbols.

In the third preferred embodiment, five fuel passages 51*c* are provided at regular intervals and radially with respect to the second restrictor hole 64 formed in a flat plate 80. This arrangement reliably shortens the length, as measured in the radial direction, of the pressure distribution generated at the valve member 41, and is particularly effective for controlling the high pressure of no less than 150 MPa. Specifically, this-arrangement reliably drops the pressure in the annular groove passage 51*b* to the drain pressure when controlling the high pressure of no less than 150 MPa. This effect increases as the number of fuel passages increases, and thus, the number is not limited to five.

(Fourth Embodiment)

Figure 9A:
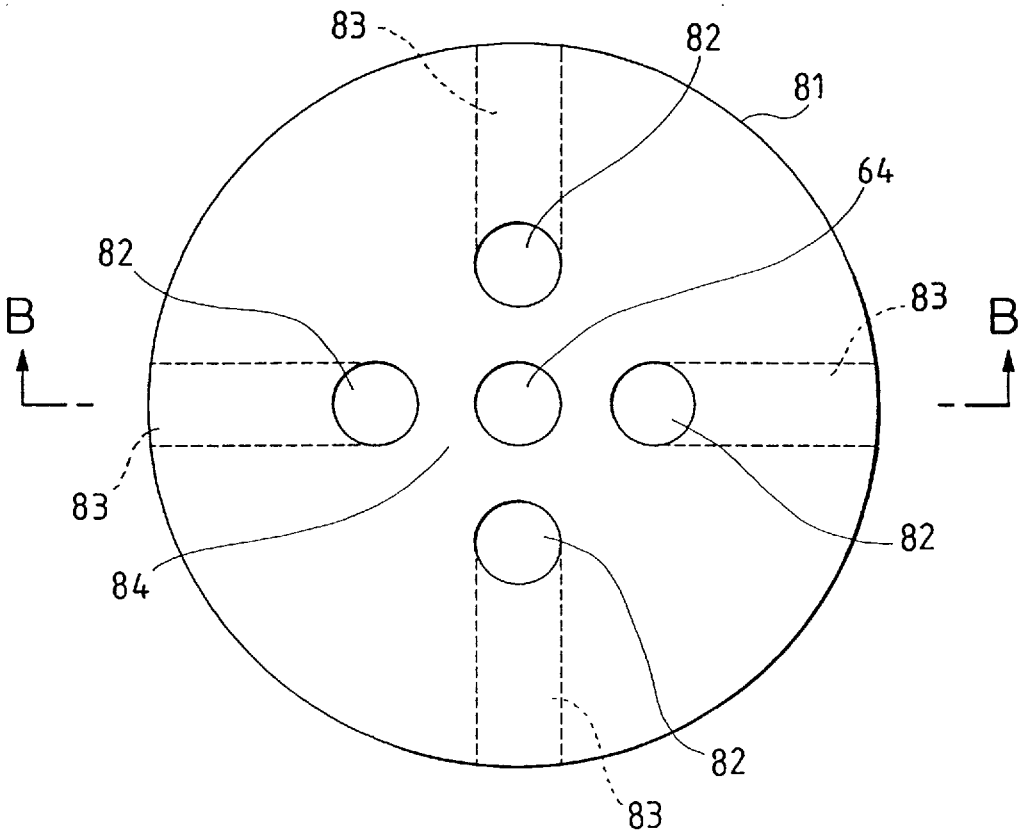
FIG. 9A is a plan view and FIG. 9B is a sectional view taken along line B—B in FIG. 9A.
Figure 9B:
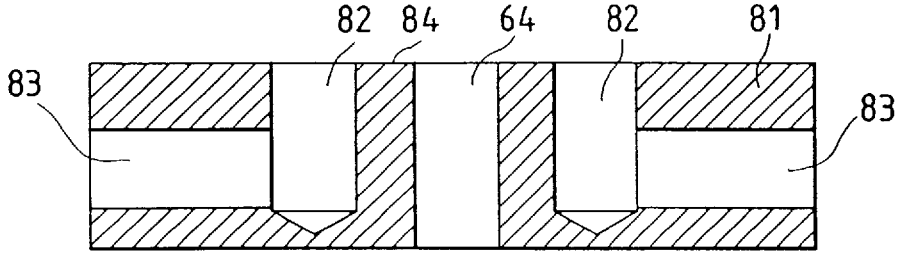

FIGS. 9A and 9B show a flat plate according to a fourth preferred embodiment of the present invention. Components which are essentially the same as those in the first preferred embodiment are assigned the same reference marks or symbols.

A flat plate 81 is formed with four fuel holes 82 around the second restrictor hole 64. The fuel holes 82 are arranged at regular intervals and opened at a side of the flat plate 81 facing the valve member. The fuel holes 82 are arranged so as not to penetrate the flat plate 81. Four fuel holes 83 are formed corresponding to the fuel holes 82. Specifically, each of the fuel holes 83 communicates with the corresponding fuel hole 82 at its non-open end and extends radially outward so as to open at the circumference of the flat plate 81. While the solenoid valve is closed, the spherical member is seated on a seat face 84 formed between the second restrictor hole 64 and the fuel holes 82 so as to prohibit communication between the pressure control chamber and the low-pressure fuel passage or the low-pressure fuel chamber.

In the fourth preferred embodiment, since the annular groove passage 51*b* is not provided as in the first to third preferred embodiments, the radial length of the pressure distribution somewhat increases at portions where no fuel hole 83 is provided so that the biasing force applied to the valve member 41 in the solenoid valve opening direction is increased. However, since all the fuel passages can be formed by drilled holes, the manufacturing cost can be largely reduced.

(Fifth Embodiment)

Figure 10A:
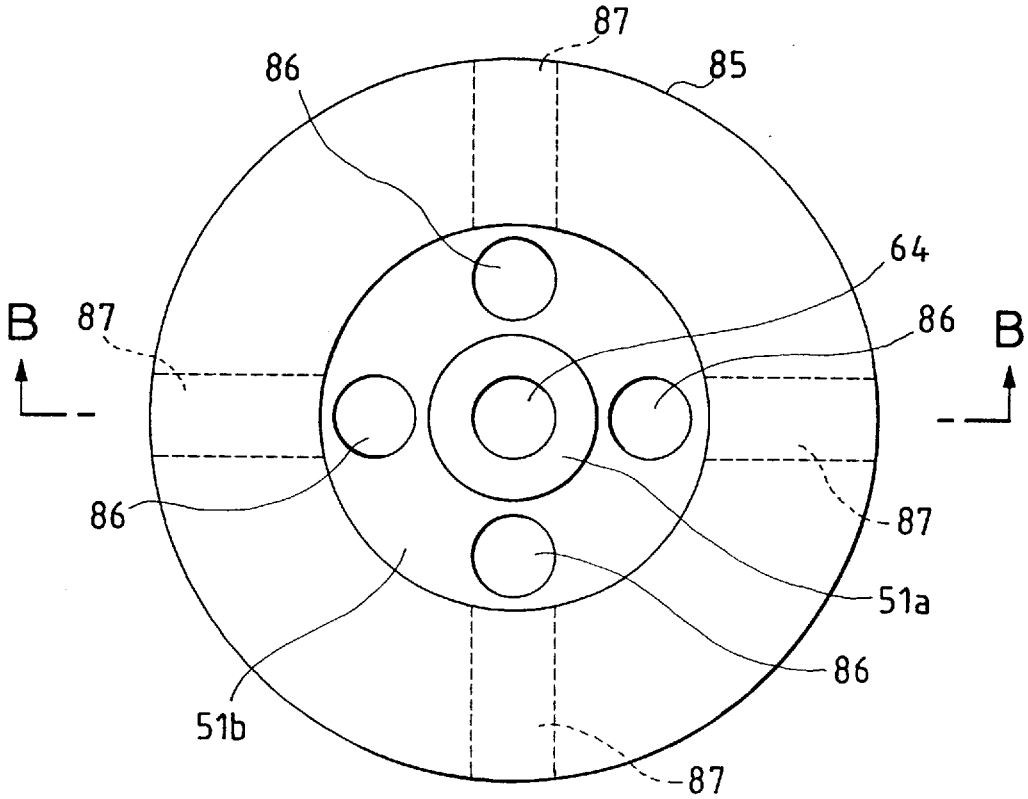
Figure 10B:
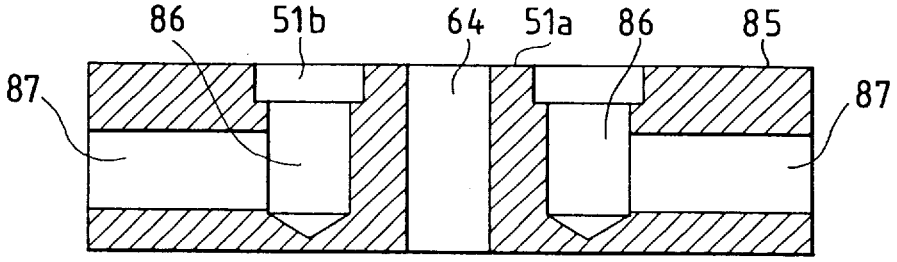

FIGS. 10A and 10B show a flat plate according to a fifth preferred embodiment of the present invention. Components which are essentially the same as those in the first preferred embodiment are assigned the same reference marks or symbols.

The fifth preferred embodiment adds the annular groove passage 51*b* to the fourth preferred embodiment so as to shorten the radial length of the pressure distribution generated at the valve member 41. Specifically, the same effect as in the first or second preferred embodiment can be achieved with the low cost.

A flat plate 85 is formed with four fuel holes 86 around the second restrictor hole 64. The fuel holes 86 are arranged at regular intervals and each of them communicates with the annular groove passage 51*b*. The fuel holes 86 are arranged so as not to penetrate the flat plate 85. Four fuel holes 87 are formed corresponding to the fuel holes 86. Specifically, each of the fuel holes 87 communicates with the corresponding fuel hole 86 at its non-open end and extends radially outward so as to open at the circumference of the flat plate 85. While the solenoid valve is closed, the spherical member is seated on the seat face 51*a* so as to prohibit communication between the pressure control chamber and the low-pressure fuel passage or the low-pressure fuel chamber.

(Sixth Embodiment)

Figure 11A:
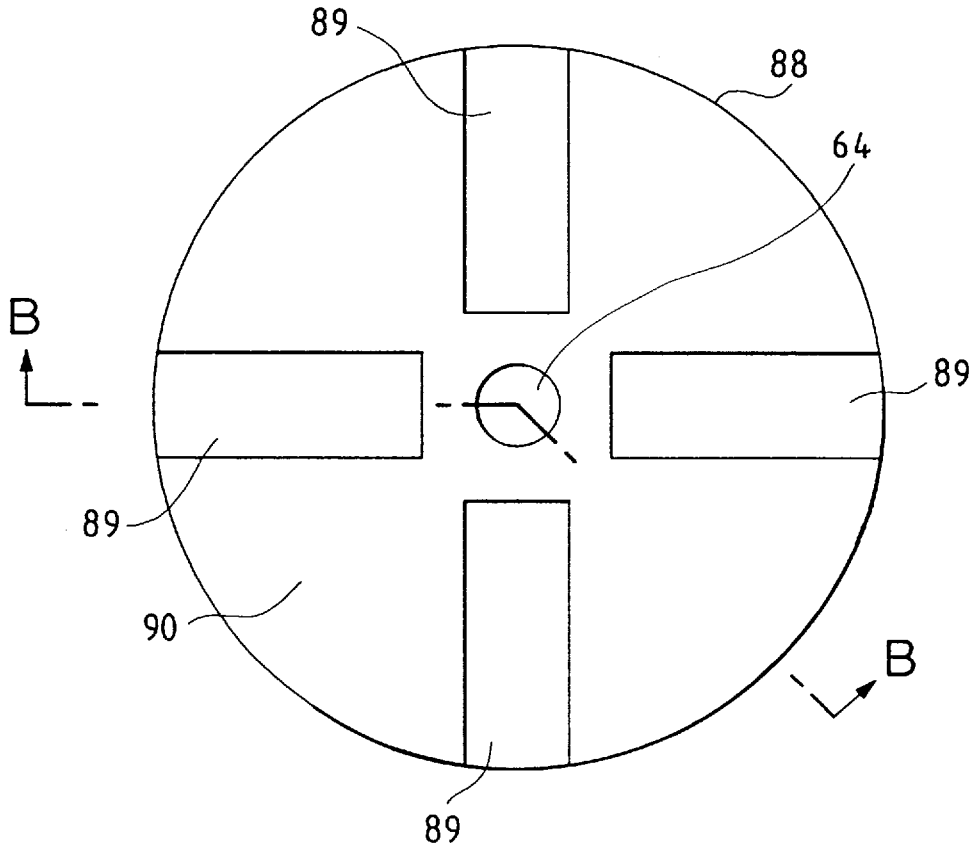
Figure 11B:
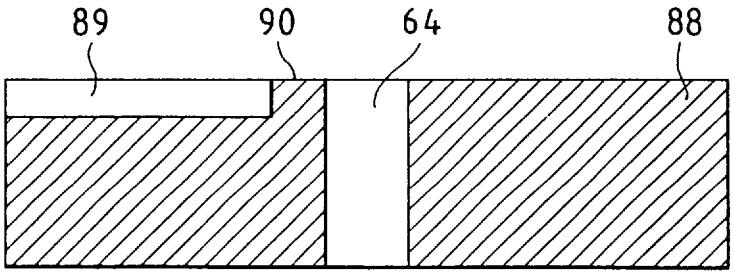

FIGS. 11A and 11B show a flat plate according to a sixth preferred embodiment of the present invention. Components which are essentially the same as those in the first preferred embodiment are assigned the same reference marks or symbols.

Four fuel passages 89 each having a rectangular shape in cross section are formed at regular intervals and radially with respect to the second restrictor hole 64. While the solenoid valve is closed, the spherical member is seated on a seat face 90 so as to prohibit communication between the pressure control chamber and the low-pressure fuel passage or the low-pressure fuel chamber.

In the sixth preferred embodiment, only the simple groove forming processing is required onto the surface of the flat plate 51. Thus, for example, it is possible to form the fuel passages 89 by press working before the hardening process of the flat plate so that the manufacturing cost can be further reduced.

(Seventh Embodiment)

Figure 12A:
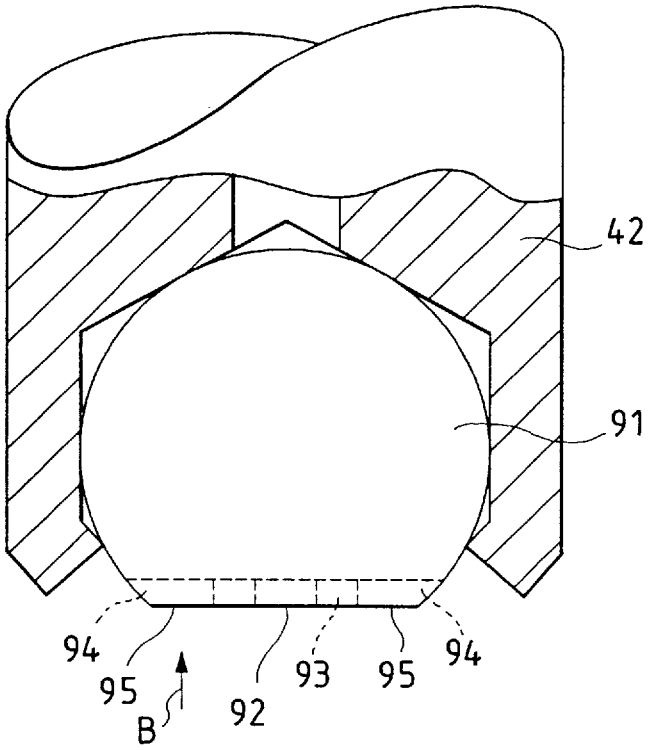
FIG. 12A is a side view and FIG. 12B is a diagram seen along an row B in FIG. 12A.
Figure 12B:
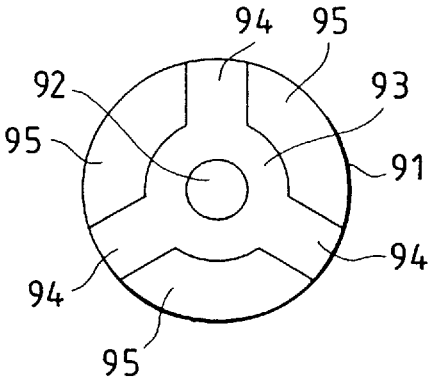
Figure 13A:
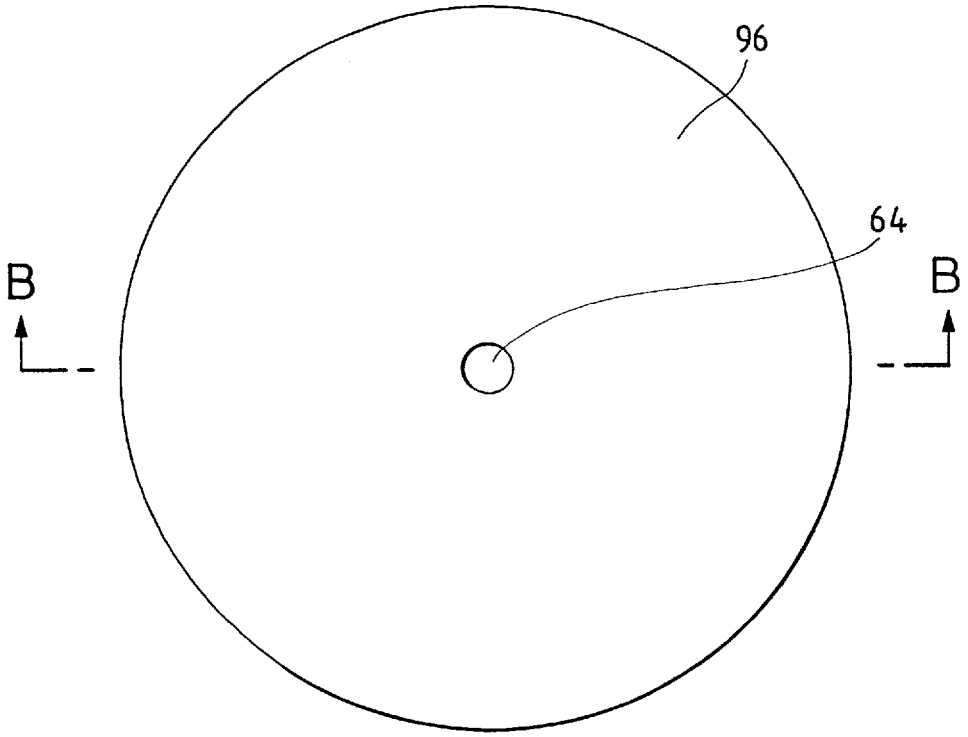
Figure 13B:
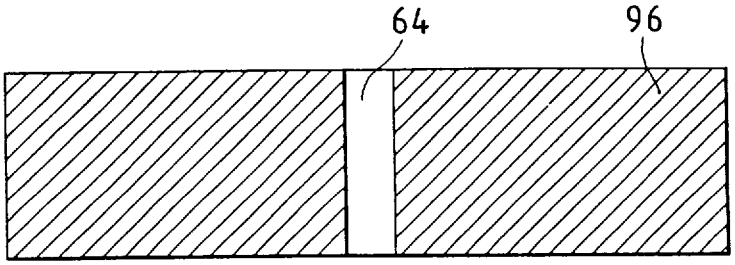

FIGS. 12A and 12B show a valve shaft and a spherical member according to a seventh preferred embodiment of the present invention, and FIGS. 13A and 13B show a flat plate according to the seventh preferred embodiment. Components which are essentially the same as those in the first preferred embodiment are assigned the same reference marks or symbols.

In the first to sixth preferred embodiments, the fuel relief passages are provided on the flat plate. On the other hand, in the seventh preferred embodiment, the fuel relief passages are provided on the spherical member.

As shown in FIGS. 12A and 12B, a circular abutting surface 92 is formed at the center of a planar portion of a spherical member 91, and an annular groove passage 93 is formed around the abutting surface 92. Three fuel groove passages 94 are provided at regular intervals and radially with respect to the abutting surface 92. Each of the fuel groove passages 94 communicates with the annular groove passage 93. As shown in FIG. 12B, the annular groove passage 93 and the fuel groove passages 94 define three fan-shaped seat faces 95. As shown in FIGS. 13A and 13B, a flat plate 96 is formed only with the second restrictor hole 64.

The number of the fuel groove passages is not limited to three. Further, as in the fourth preferred embodiment, the fuel holes may be formed instead of fuel passages.

In the seventh preferred embodiment, since the flat plate 96 is formed only with the second restrictor hole 64, the flat plate has no thin portions near the fuel groove passages or the fuel holes as in the first and third to sixth preferred embodiments so that the excellent sealing property can be ensured.

(Eighth Embodiment)

Figure 14:
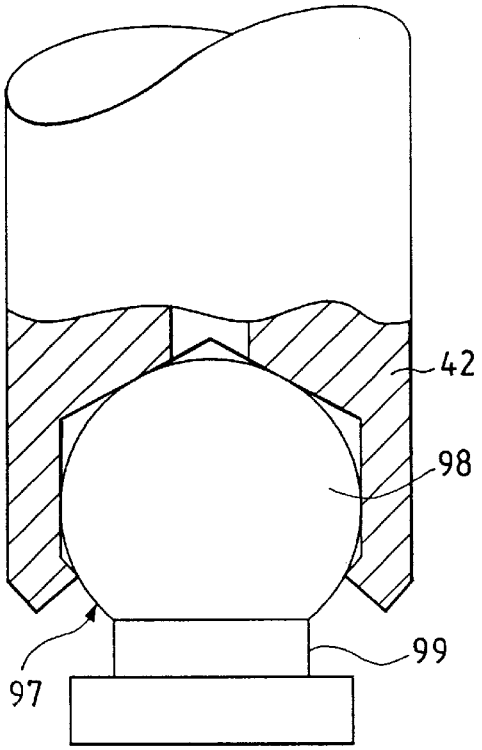
FIG. 14 is a side view showing a valve shaft and a spherical member according to an eighth preferred embodiment of the present invention.

FIG. 14 shows a valve shaft and a spherical member according to an eighth preferred embodiment of the present invention. Components which are essentially the same as those in the first preferred embodiment are assigned the same reference marks or symbols.

A spherical member 97 is formed by, for example, cutting, and includes a spherical portion 98 and a disc portion 99. By providing the disc portion 99 to the spherical portion 98, the seating area of the solenoid valve can be changed without changing the size of the spherical portion 98. The spherical member may be formed by welding the spherical portion and the disc portion together.

(Ninth Embodiment)

Figure 15:
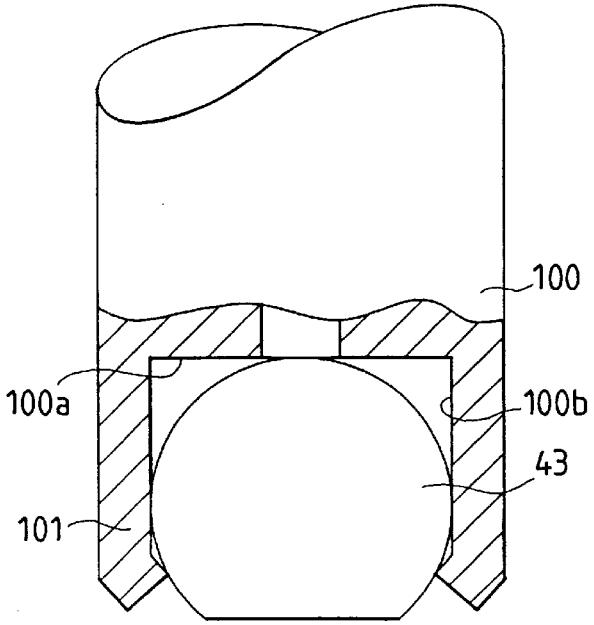
FIG. 15 is a side view showing a valve shaft and a spherical member according to a ninth preferred embodiment of the present invention.

FIG. 15 shows a valve shaft and a spherical member according to a ninth preferred embodiment of the present invention.

A concave portion formed at the tip of a shaft 100 includes a circular planar surface 100*a* and a cylindrical inner surface 100*b*. The spherical member 43 is slidably supported in this concave portion. By caulking the tip of a cylindrical wall 101 after the spherical member 43 is received in the concave portion of the shaft 100, the spherical member 43 is prevented from falling off the shaft 100.

Since the ninth preferred embodiment employs the combination of the spherical member and the corresponding planar surface, the inclination or the axial offset of the spherical member 43 can be prevented as in the first to eighth preferred embodiments.

(Tenth Embodiment)

Figure 16:
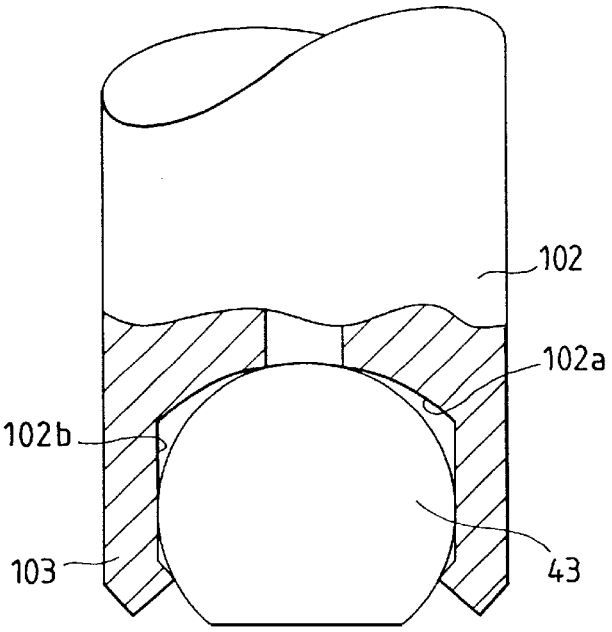
FIG. 16 is a side view showing a valve shaft and a spherical member according to a tenth preferred embodiment of the present invention.

FIG. 16 shows a valve shaft and a spherical member according to a tenth preferred embodiment of the present invention.

A concave portion formed at the tip of a shaft 102 includes a spherical concave surface 102*a* and a cylindrical inner surface 102*b*. The spherical member 43 is slidably supported in this concave portion. By caulking the tip of a cylindrical wall 103 after the spherical member 43 is received in the concave portion of the shaft 102, the spherical member 43 is prevented from falling off the shaft 102.

Since the tenth preferred embodiment employs the combination of the spherical member and the corresponding spherical concave surface, the inclination or the axial offset of the spherical member 43 can be prevented as in the first to ninth preferred embodiments.

(Eleventh Embodiment)

Figure 17:
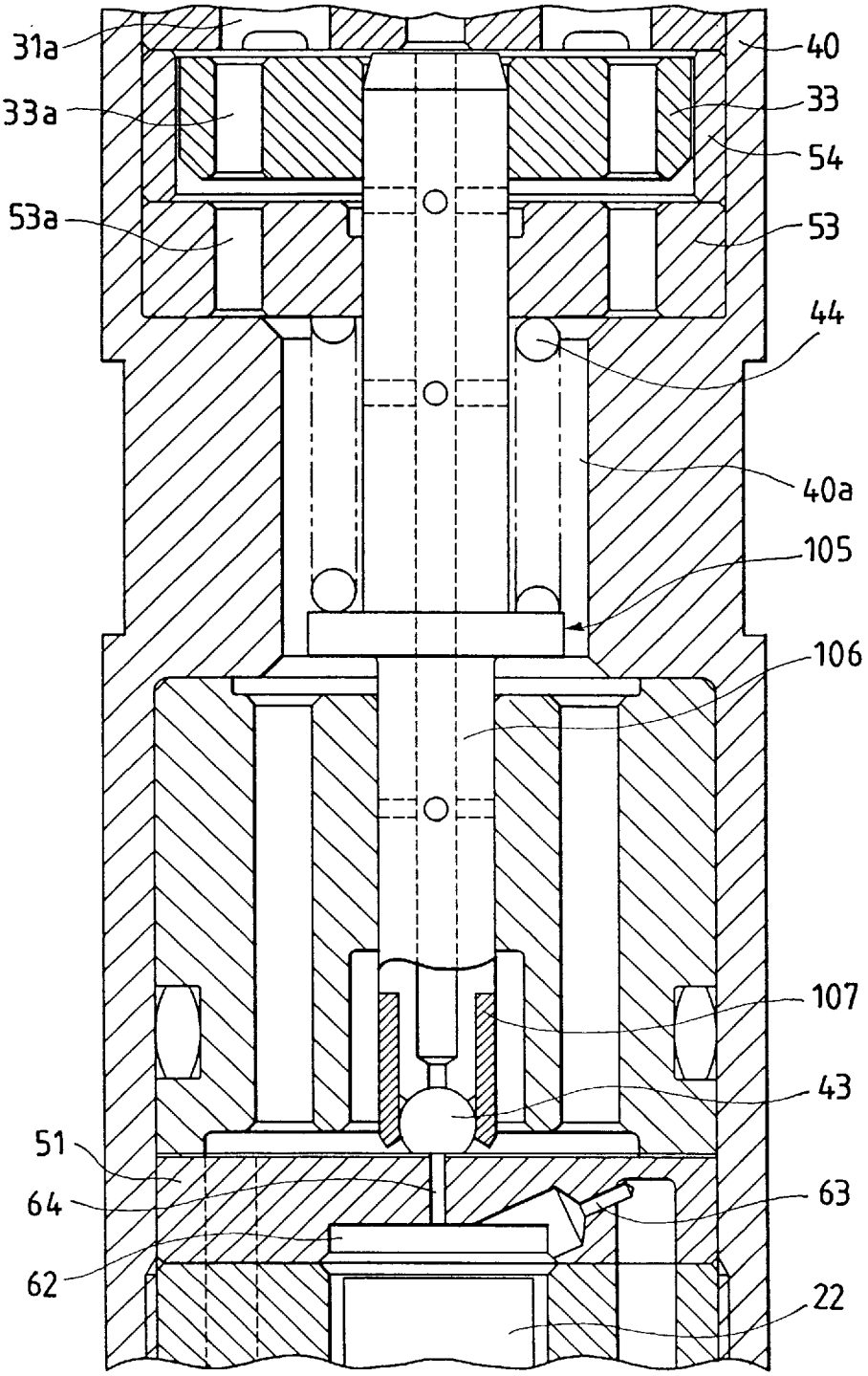
FIG. 17 is a sectional view showing the main portion of an accumulator fuel injection device according to an eleventh preferred embodiment of the present invention.
Figure 18:
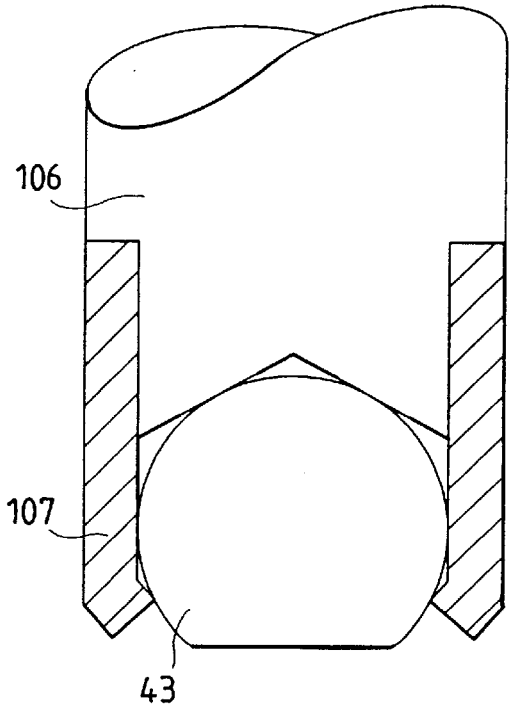
FIG. 18 is a side view showing a valve shaft and a spherical member according to the eleventh preferred embodiment.

FIG. 17 shows the main portion of an accumulator fuel injection device according to an eleventh preferred embodiment of the present invention, and FIG. 18 shows a valve shaft and a spherical member according to the eleventh preferred embodiment. Components which are essentially the same as those in the first preferred embodiment are assigned the same reference marks or symbols.

In the first to tenth preferred embodiments, the valve member is composed of two members, that is, the shaft and the spherical member, and the spherical member is slidably supported by the shaft. On the other hand, in the eleventh preferred embodiment, a valve member 105 is composed of three members, that is, a shaft 106, a support member 107 and the spherical member 43. The spherical member 43 is slidably supported by the shaft 106 and the support member 107.

The outer tip wall of the shaft 106 is cut into a cylindrical shape, and the cylindrical support member 107 is coupled to this outer tip wall by press fitting, welding or both of them. By mounting the support member 107 on the shaft 106 and caulking the tip of the support member 107 after the spherical member 43 is received in the support member 107, the spherical member 43 is prevented from falling off. In the eleventh preferred embodiment, the shaft 106 and the support member 107 are produced as separate members so that the processing of the shaft 106 is facilitated.

(Twelfth Embodiment)

Figure 19:
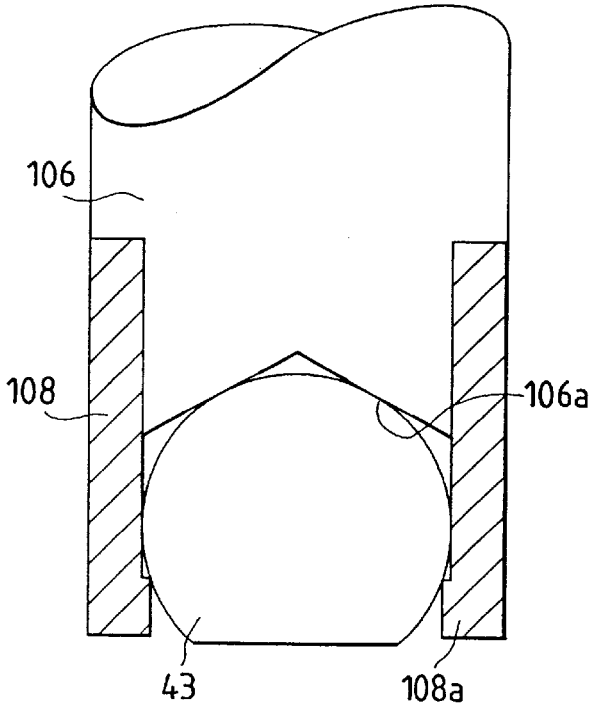
FIG. 19 is a side view showing a valve shaft and a spherical member according to a twelfth preferred embodiment of the present invention.

FIG. 19 shows a valve shaft and a spherical member according to a twelfth preferred embodiment of the present invention. Components which are essentially the same as those in the first preferred embodiment are assigned the same reference marks or symbols.

In the twelfth preferred embodiment, a projection 108*a* for preventing the spherical member 43 is provided at the tip of a cylindrical support member 108 in advance. After the spherical member 43 is received in the support member 108, the support member 108 is mounted on the shaft 106 by press fitting or welding.

(Thirteenth Embodiment)

Figure 20:
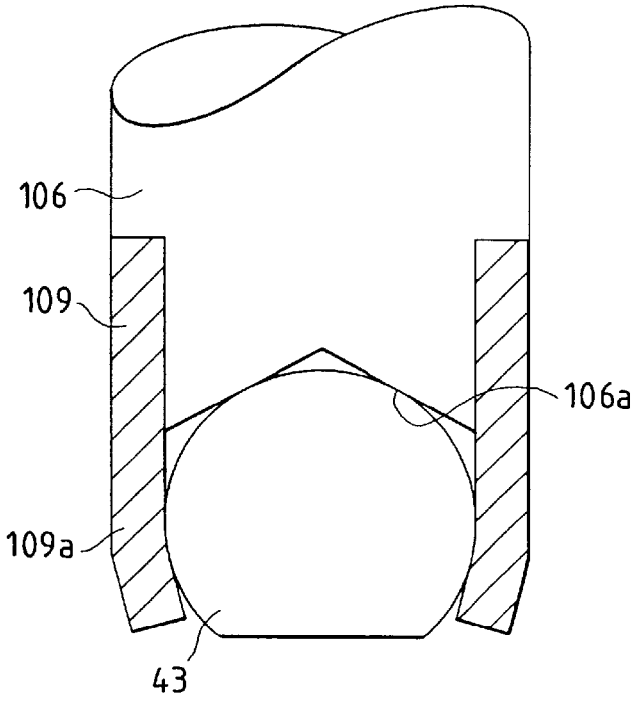
FIG. 20 is a side view showing a valve shaft and a spherical member according to a thirteenth preferred embodiment of the present invention.

FIG. 20 shows a valve shaft and a spherical member according to a thirteenth preferred embodiment of the present invention. Components which are essentially the same as those in the first preferred embodiment are assigned the same reference marks or symbols.

In the thirteenth preferred embodiment, a tapered portion 109*a* having gradually decreasing inner diameters is provided at the tip of a cylindrical support member 109 so as to prevent the spherical member 43 from falling off. In the thirteenth preferred embodiment, as in the twelfth preferred embodiment, the tapered portion 109*a* is provided at the tip of the support member 109 in advance, and the support member 109 is mounted on the shaft 106 by press fitting or welding after the spherical member 43 is received in the support member 109.

In the eleventh to thirteenth preferred embodiment, since the support member and the shaft 106 are separately formed, the heat treatment of the shaft 106 becomes very easy. The shaft 106 is subjected to the heat treatment for the purpose of ensuring the durability of a guide portion (slide portion) movable due to the operation of the solenoid valve 30 and the durability of a high stress generating surface (contact surface with spherical member). Thus, if, as in the first preferred embodiment, the tip of the shaft is caulked in the final process so as to prevent the spherical member from falling off, for example, the cementing heat treatment is performed after the caulked tip portion is subjected to the carbon prevention treatment using the alloy steel as a material. However, since the diameter of the spherical member is very small, that is, 2.0 mm as shown in the first preferred embodiment, the length of the shaft tip portion subjected to the carbon prevention treatment is very small so that it takes time to perform this carbon prevention treatment. In view of this, in the eleventh to thirteenth preferred embodiments, the cylindrical support member is provided separately from the shaft so that the heat treatment operation of the shaft is facilitated. Since the hardening process is applied to the shaft 106 before the assembling process, the heat treatment can be achieved very easily.

Further, in the eleventh to thirteenth preferred embodiments, the support member is mounted on the shaft 106 by press fitting or welding. On the other hand, the support member may be mounted on the shaft by means of screws.

While the present invention has been described in terms of the preferred embodiments, the invention is not to be limited thereto, but can be embodied in various ways without departing from the principle of the invention as defined in the appended claims.

What is claimed is:

1. An accumulator fuel injection device for injecting an accumulated high-pressure fuel toward a cylinder of an internal combustion engine, said accumulator fuel injection device comprising:

a control piston for controlling opening and closing of a fuel injection hole;

a pressure control chamber for urging said control piston in a direction to affect a closing of said fuel injection hole using fuel pressure supplied from a high-pressure fuel passage;

a restrictor hole formed between a low-pressure space and said pressure control chamber; and a solenoid valve for controlling communication between said low pressure space and said pressure control chamber, said solenoid valve comprising:

a substantially flat valve seat formed with said restrictor hole;

a valve member, said valve member and said substantially flat valve seat defining a tight contact region therebetween when said valve member and said substantially flat valve seat are engaged;

an annular groove passage formed on said substantially flat valve seat such that said annular groove passage is disposed in said tight contact region and communicates with said low-pressure space when said substantially flat valve seat and said valve member are engaged, and a wall separating said annular groove passage and said restrictor hole, said wall having a thickness smaller than an inner diameter of said restrictor hole.

2. The accumulator fuel injection device according to claim 1, wherein said annular groove passage gradually increases in depth from an innermost side thereof toward an outward side thereof.

3. The accumulator fuel injection device according to claim 1, wherein when said valve member is engaged with said substantially flat valve seat, said valve member is in a tight plane contact with inner and outer portions of said substantially flat valve seat.

4. The accumulator fuel injection device according to claim 1, wherein said valve member includes:

a spherical member constructed and arranged to engage said substantially flat valve seat, said spherical member having a spherical convex surface, and a shaft member having a spherical concave surface, a conical concave surface or a planar surface for abutting said spherical convex surface in an axial direction thereof, said shaft member being constructed and arranged to support said spherical member such that said spherical member is slidable relative to said shaft member.

5. The accumulator fuel injection device according to claim 4, wherein a planar surface of said spherical member is constructed and arranged to engage said substantially flat valve seat, said planar surface being formed by cutting a portion of a steel ball through postprocessing.

6. The accumulator fuel injection device according to claim 4, wherein said valve member has a support member mounted on said shaft member, said support member preventing said spherical member from falling off by means of caulking, reduction in inner diameter, or a projection.

7. The accumulator fuel injection device according to claim 4, wherein said valve member includes a cylindrical support member provided at an end portion of said shaft member, said cylindrical support member preventing said spherical member from falling off by caulking a tip portion of said cylindrical support member after receiving said spherical member therein.

8. The accumulator fuel injection device according to claim 1, wherein an inner diameter of said annular groove passage is no more than 1.0 mm.

9. The accumulator fuel injection device according to claim 1, wherein a further restrictor hole is provided between said high-pressure fuel passage and said pressure control chamber for regulating a flow of fuel into said pressure control chamber, said further restrictor hole having a passage resistance greater than that of the aforementioned restrictor hole.

10. An accumulator fuel injection device for injecting an accumulated high-pressure fuel toward a cylinder of an internal combustion engine, said accumulator fuel injection device comprising:

a control piston for controlling opening and closing of a fuel injection hole;

a pressure control chamber for urging said control piston in a direction to affect a closing of said fuel injection hole using fuel pressure supplied from a high-pressure fuel passage;

a restrictor hole formed between a low-pressure space and said pressure control chamber; and a solenoid valve for controlling communication between said low-pressure space and said pressure control chamber, said solenoid valve comprising:

a substantial flat valve seat formed with said restrictor hole;

a valve member, said valve member and said substantially flat valve seat defining a tight contact region therebetween when said valve member and said flat valve seat are engaged, a biasing structure for biasing said valve member towards said substantially flat valve seat;

a solenoid for attracting said valve member in a direction away from said substantially flat valve seat when said solenoid is energized;

a fuel relief passage formed on said substantial flat valve seat or said valve member such that said fuel relief passage is disposed in said tight contact region and communicates with said low-pressure space when said substantially flat valve seat and said valve member are engaged, said fuel relief passage including an annular groove passage formed essentially concentric with said restrictor hole and at least one fuel passage having one end communicating with said annular groove passage and another end communicating with said low-pressure space; and a wall separating said annular groove passage and said restrictor hole from each other, said wall having a thickness smaller than an inner diameter of said restrictor hole.

11. The accumulator fuel injection device according to claim 10, wherein said at least one fuel passage includes at least two fuel passages, said fuel passages being arranged symmetrically with respect to said restrictor hole.

12. The accumulator fuel injection device according to claim 10, wherein said biasing structure is disposed between said solenoid and said substantially flat valve seat, said biasing structure being a spring member receiving said valve member therethrough.

13. The accumulator fuel injection device according to claim 10, wherein said annular groove passage gradually increases in depth from an innermost side thereof toward an outward side thereof.

14. The accumulator fuel injection device according to claim 10, wherein when said valve member is engaged with said substantially flat valve seat, said valve member is in a tight plane contact with inner and outer portions of said substantially flat valve seat.

15. The accumulator fuel injection device according to claim 10, wherein said valve member includes:

a spherical member constructed and arranged to engage said substantially flat valve seat, said spherical member having a spherical convex surface, and a shaft member having a spherical concave surface, a conical concave surface or a planar surface for abutting said spherical convex surface in an axial direction thereof, said shaft member being constructed and arranged to support said spherical member such that said spherical member is slidable relative to said shaft member.

16. The accumulator fuel injection device according to claim 15, wherein a planar surface of said spherical member is constructed and arranged to engage said substantially flat valve seat, said planar surface being formed by cutting a portion of a steel ball through postprocessing.

17. The accumulator fuel injection device according to claim 15, wherein said valve member has a support member mounted on said shaft member, said support member preventing said spherical member from falling off by means of caulking, reduction in inner diameter, or a projection.

18. The accumulator fuel injection device according to claim 15, wherein said valve member includes a cylindrical support member provided at an end portion of said shaft member, said cylindrical support member preventing said spherical member from falling off by caulking a tip portion of said cylindrical support member after receiving said spherical member therein.

19. The accumulator fuel injection device according to claim 10, wherein an inner diameter of said annular groove passage is no more than 1.0 mm.

20. The accumulator fuel injection device according to claim 10, wherein a further restrictor hole is provided between said high-pressure fuel passage and said pressure control chamber for regulating a flow of fuel into said pressure control chamber, said further restrictor hole having a passage resistance greater than that of the aforementioned restrictor hole.

21. In an accumulator fuel injection system in which high-pressure fuel accumulated in a common rail is supplied to a fuel injector provided for each cylinder of a diesel internal combustion engine so as to inject the fuel into the corresponding cylinder through an injection nozzle of the fuel injector, said fuel injector comprising:

a nozzle needle constructed and arranged to control communication between a high-pressure fuel passage and an injection hole of the injection nozzle, said high-pressure fuel passage being adapted to feed high-pressure fuel to said injection hole;

a control piston provided at a side of said nozzle needle remote from said injection hole, said control piston being movable backward and forward along with said nozzle needle;

a low-pressure space;

a pressure control chamber, said pressure control chamber being constructed and arranged to urge said control piston in a direction to close said injection hole in response to fuel pressure supplied by said high-pressure fuel passage;

a solenoid valve constructed and arranged to control communication between said pressure control chamber and said low-pressure space;

a first restrictor hole provided between said high-pressure fuel passage and said pressure control chamber for regulating a flow of the fuel into said pressure control chamber; and a second restrictor hole provided between said pressure control chamber and said low-pressure space, said second restrictor hole having a passage resistance smaller than that of said first restrictor hole, said solenoid valve comprising:

a substantially flat valve seat formed with said second restrictor hole, a valve member, said valve member and said substantially flat valve seat defining a tight contact region therebetween when said valve member and said substantially flat valve seat are engaged, a biasing structure for biasing said valve member towards said substantially flat valve seat, a solenoid attracting said valve member in a direction away from said substantially flat valve seat when said solenoid is energized, communication between said pressure control chamber and said low-pressure space being prohibited when said valve member and said substantially flat valve seat are engaged and communication between said pressure control chamber and said low-pressure space being permitted when said valve member is moved away from said substantially flat valve seat, a fuel relief passage formed on one of said substantially flat valve seat or said valve member such that said fuel relief passage is disposed in said tight contact region and communicates with said low-pressure space when said substantially flat valve seat and said valve member are engaged, said fuel relief passage including an annular groove passage formed essentially concentric with said second restrictor hole and at least one fuel passage having one end communicating with said annular groove passage and another end communicating with said low-pressure space, and a wall separating said annular groove passage and said second restrictor hole from each other, said wall having a thickness smaller than an inner diameter of said second restrictor hole.

22. An accumulator fuel injection device for injecting an accumulated high-pressure fuel toward a cylinder of an internal combustion engine, said accumulator fuel injection device comprising:

a control piston for controlling opening and closing of a fuel injection hole;

a pressure control chamber for urging said control piston in a direction to affect a closing of said injection hole using fuel pressure supplied from a high-pressure fuel passage;

a restrictor hole formed between a low-pressure space and said pressure control chamber; and a solenoid valve for controlling communication between said low-pressure space and said pressure control chamber, said solenoid valve comprising:

a substantially flat valve seat formed with said restrictor hole;

a valve member, said valve member and said substantially flat valve seat defining a tight contact region therebetween when said valve member and said substantially flat valve seat are engaged; and an annular groove passage formed on said substantially flat valve seat such that said annular groove passage is disposed in said tight contact region and communicates with said low-pressure space when said substantially flat valve seat and said valve member are engaged, wherein an inner diameter of said annular groove passage is set greater than an inner diameter of said restrictor hole and no greater than 1.0 mm.

23. In an accumulator fuel injection system in which high-pressure fuel accumulated in a common rail is supplied to a fuel injector provided for each cylinder of a diesel internal combustion engine so as to inject the fuel into the corresponding cylinder though an injection nozzle of the fuel injector, said fuel injector comprising:

a nozzle needle for controlling communication between a high-pressure fuel passage and an injection hole of the injection nozzle, said high-pressure fuel passage being adapted to feed the high-pressure fuel to said injection hole;

a control piston provided at a side of said nozzle needle remote from said injection hole, said control piston being movable backward and forward along with said nozzle needle;

a solenoid valve for controlling communication between a pressure control chamber and a low-pressure space, said pressure control chamber capable of urging said control piston in a direction to to affect a closing of said injection hole in response to fuel pressure supplied from said high-pressure fuel passage;

a first restrictor hole provided between said high-pressure fuel passage and said pressure control chamber for regulating a flow of the fuel into said pressure control chamber; and a second restrictor hole provided between said pressure control chamber and said low-pressure space and having a passage resistance smaller than that of said first restrictor hole, said solenoid valve comprising:

a substantially flat valve seat formed with said second restrictor hole, a valve member, said valve member and said substantially flat valve seat defining a tight contact region therebetween when said valve member and said substantially flat valve seat are engaged, a biasing structure for biasing said valve member toward said substantially flat valve seat, a solenoid attracting said valve member in a direction away from said substantial flat valve seat when said solenoid is energized, communication between said pressure control chamber and said low-pressure space being prohibited when said valve member and said substantially flat valve seat are engaged and communication between said pressure control chamber and said low-pressure space being permitted when said valve member is moved away from said substantially flat valve seat, a fuel relief passage formed on one of said substantial flat valve seat or said valve member such that said fuel relief passage is disposed in said tight contact region and communicates with said low-pressure chamber when said substantially flat valve seat and said valve member are engaged, said fuel relief passage including an annular groove passage formed essentially concentric with said second restrictor hole and at least one fuel passage having one end communicating with said annular groove passage and another end communicating with said low-pressure space, wherein an inner diameter of said annular groove passage is set no greater than 1.0 mm.

24. An accumulator fuel supplying device for supplying an accumulated high-pressure fuel toward an internal combustion engine, said accumulator fuel supplying device comprising:

a control piston for controlling opening and closing of a fuel supplying hole;

a pressure control chamber urging said control piston in a direction to affect a closing of said fuel injection hole using pressure supplied from a high-pressure space;

a restrictor hole formed between a low-pressure space and said pressure control chamber; and a control valve controlling communication between said low-pressure space and said pressure control chamber, said control valve comprising:

a valve structure formed with said restrictor hole, said valve structure having a valve seat and a valve member constructed and arranged to engage one another, said valve seat and said valve member defining a tight contact region therebetween when said valve seat and said valve member are engaged;

an annular groove passage formed in said valve structure such that said annular groove is disposed in said tight contact region and communicates with said low-pressure space when said valve seat and said valve member are engaged; and a wall separating said annular groove passage and said restrictor hole from each other, said wall having a thickness smaller than an inner diameter of said restrictor hole.

25. The accumulator fuel injection device according to claim 24, wherein said annular groove passage gradually increases in depth from an innermost side thereof toward an outward side thereof.

26. The accumulator fuel injection device according to claim 24, wherein when said valve member is engaged with said valve seat, said valve member is in a tight plane contact with inner and outer portions of said valve seat.

27. The accumulator fuel injection device according to claim 24, wherein said valve member includes:

a spherical member constructed and arranged to engage said valve seat, said spherical member having a spherical convex surface, and a shaft member having a spherical concave surface, a conical concave surface or a planar surface for abutting said spherical convex surface in an axial direction thereof, said shaft member being constructed and arranged to support said spherical member such that said spherical member is slidable relative to said shaft member.

28. The accumulator fuel injection device according to claim 24, wherein a planar surface of said spherical member is constructed and arranged to engage said valve seat, said planar surface being formed by cutting a portion of a steel ball through postprocessing.

29. The accumulator fuel injection device according to claim 24, wherein said valve member has a support member mounted on said shaft member, said support member preventing said spherical member from falling off by means of caulking, reduction in inner diameter, or a projection.

30. The accumulator fuel injection device according to claim 24, wherein said valve member includes a cylindrical support member provided at an end portion of said shaft member, said cylindrical support member preventing said spherical member from falling off by caulking a tip portion of said cylindrical support member after receiving said spherical member therein.

31. The accumulator fuel injection device according to claim 24, wherein an inner diameter of said annular groove passage is no more than 1.0 mm.

32. The accumulator fuel injection device according to claim 24, wherein a further restrictor hole is provided between said high-pressure fuel passage and said pressure control chamber for regulating a flow of fuel into said pressure control chamber, said further restrictor hole having a passage resistance greater than that of the aforementioned restrictor hole.

33. A fuel supply system for supplying fuel toward an internal combustion engine, said fuel supply system comprising:

an accumulator accumulating high-pressure fuel;

a control piston controlling opening and closing of a fuel supplying hole;

a pressure control chamber urging said control piston in a direction to affect a closing of said fuel injection hole using fuel accumulated by said accumulator;

a restrictor hole formed between a low-pressure space and said pressure control chamber; and a control valve controlling communication between said low-pressure space and said pressure control chamber, said control valve comprising:

a valve structure formed with said restrictor hole, said valve structure having a valve seat and a valve member constructed and arranged to engage one another, said valve member and said valve seat defining a tight contact region therebetween when said valve seat and said valve member are engaged;

an annular groove passage formed in said valve structure such that said annular groove is disposed in said tight contact region and communicates with said low-pressure space when said valve seat and said valve member are engaged, and a wall separating said annular groove passage and said restrictor hole from each other, said wall having a thickness smaller than an inner diameter of said restrictor hole.

34. A mechanical power generating system comprising an internal combustion engine and a fuel supply system for supplying fuel toward said internal combustion engine, said fuel supply system comprising:

an accumulator accumulating high-pressure fuel;

a control piston controlling opening and closing of a fuel supplying hole;

a pressure control chamber urging said control piston in a direction to affect a closing of said fuel injection hole using fuel accumulated by said accumulator;

a restrictor hole formed between a low-pressure space and said pressure control chamber; and a control valve controlling communication between said low-pressure space and said pressure control chamber, said control valve comprising:

a valve structure formed with said restrictor hole, said valve structure having a valve seat and a valve member constructed and arranged to engage one another, said valve member and said valve seat defining a tight contact region therebetween when said valve member and valve seat are in engagement;

an annular groove passage formed on said valve structure such that said annular groove is disposed in said tight contact region and communicates with said low-pressure space when said valve seat and said valve member are engaged; and a wall separating said annular groove passage and said restrictor hole from each other, said wall having a thickness smaller than an inner diameter of said restrictor hole.

* * * * *